US007865096B2

(12) United States Patent
Tsunoda

(10) Patent No.: US 7,865,096 B2
(45) Date of Patent: Jan. 4, 2011

(54) IMAGE FORMING APPARATUS AND METHOD OF PERFORMING DENSITY CORRECTION

(75) Inventor: Arihiro Tsunoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 147 days.

(21) Appl. No.: 12/216,740

(22) Filed: Jul. 10, 2008

(65) Prior Publication Data

US 2009/0041490 A1 Feb. 12, 2009

(30) Foreign Application Priority Data

Aug. 9, 2007 (JP) ..... 2007-207938

(51) Int. Cl.
*G03G 15/00* (2006.01)

(52) U.S. Cl. ..... 399/49; 399/72

(58) Field of Classification Search ..... 399/27, 399/29, 30, 49, 60–62, 72
See application file for complete search history.

(56) References Cited

U.S. PATENT DOCUMENTS 6,044,234 A * 3/2000 Yoshizawa ..... 399/49

FOREIGN PATENT DOCUMENTS

JP 2004-341100 12/2004
JP 2006-064897 3/2006

* cited by examiner

*Primary Examiner*—Hoang Ngo
(74) *Attorney, Agent, or Firm*—Kubotera & Associates LLC

(57) ABSTRACT

An image forming apparatus includes an image supporting member; an exposure device for forming a static latent image on the image supporting member; a developing device for developing the static latent image formed on the image supporting member; an image control unit for controlling a condition for forming an image; and a density sensor for detecting a developer density. In the image forming apparatus, a first pattern for detecting the developer density is formed to determine whether the developer density is proper. When the developer density thus detected is greater than a threshold value, a second pattern for discarding developer is formed to discard the developer. A third pattern for density correction is formed to perform the density correction.

13 Claims, 18 Drawing Sheets

| | V1 | V2 | V3 | V4 | V5 |
|---|---|---|---|---|---|
| E | 0.1 | 0.2 | 0.45 | 0.85 | 1.15 |
| Standard B | 0.09 | 0.12 | 0.18 | 0.6 | 0.95 |

| | Potential (V) | Amount (g/cm$^2$) |
|---|---|---|
| After placing | -90 | 0.6 |
| After printing operation | -60 | 0.4 |

| | V1 | V2 | V3 | V4 | V5 |
|---|---|---|---|---|---|
| F | 0.1 | 0.2 | 0.45 | 0.85 | 1.15 |
| Standard D | 0.09 | 0.12 | 0.18 | 0.6 | 0.95 |

| | V1 | V2 | V3 | V4 | V5 |
|---|---|---|---|---|---|
| E | 2.2 | 2.2 | 1.6 | 0.5 | 0.2 |
| Standard B | 2.25 | 2.25 | 1.9 | 0.9 | 0.3 |

IMAGE FORMING APPARATUS AND METHOD OF PERFORMING DENSITY CORRECTION

BACKGROUND OF THE INVENTION

The present invention relates to an image forming apparatus and a method of performing density correction for the image forming apparatus.

A conventional image forming apparatus performs a printing operation after density correction is performed (refer to Patent Reference).

Patent Reference: Japan Patent Publication No. 2004-341100

In the conventional image forming apparatus, when density abnormality occurs due to deterioration of toner after placing for a long period of time, the density correction is performed according to the density abnormality. Accordingly, when the conventional image forming apparatus performs a printing operation, image quality tends to deteriorate upon printing.

In view of the problem described above, an object of the invention is to provide an image forming apparatus, in which it is possible to solve the problems of the conventional image forming apparatus. In the image forming apparatus of the present invention, when a density of a density detection pattern exceeds a threshold value, a developer discarding pattern is formed, thereby discarding deteriorated developer. After discarding the deteriorated developer, density correction is performed. Accordingly, even when density abnormality occurs due to deterioration of developer, it is possible to properly perform the density correction. As a result, it is possible to reproduce a proper density, proper hue, and the like of an image.

Further objects of the invention will be apparent from the following description of the invention.

SUMMARY OF THE INVENTION

In order to attain the objects described above, according to the present invention, an image forming apparatus includes an image supporting member; an exposure device for forming a static latent image on the image supporting member; a developing device for developing the static latent image formed on the image supporting member; an image control unit for controlling a condition for forming an image; and a density sensor for detecting a developer density.

In the image forming apparatus, a first pattern for detecting the developer density is formed to determine whether the developer density is proper. When the developer density thus detected is greater than a threshold value, a second pattern for discarding developer is formed to discard the developer. A third pattern for density correction is formed to perform the density correction.

As described above, in the image forming apparatus of the present invention, when the developer density of the first pattern for detecting the developer density is greater than the threshold value, the second pattern for discarding developer is formed to discard the developer that is deteriorated. Afterward, the third pattern for the density correction is formed to perform the density correction. Accordingly, even when density abnormality occurs due to deterioration of developer, it is possible to properly perform the density correction. As a result, it is possible to reproduce a proper density, proper hue, and the like of an image.

DETAILED DESCRIPTION OF THE PREFERRED EMBODIMENTS

Hereunder, embodiments of the present invention will be described in more detail with reference to the accompanying drawings. A printer of an electro-photography type will be explained as an image forming apparatus.

First Embodiment

Figure 1:
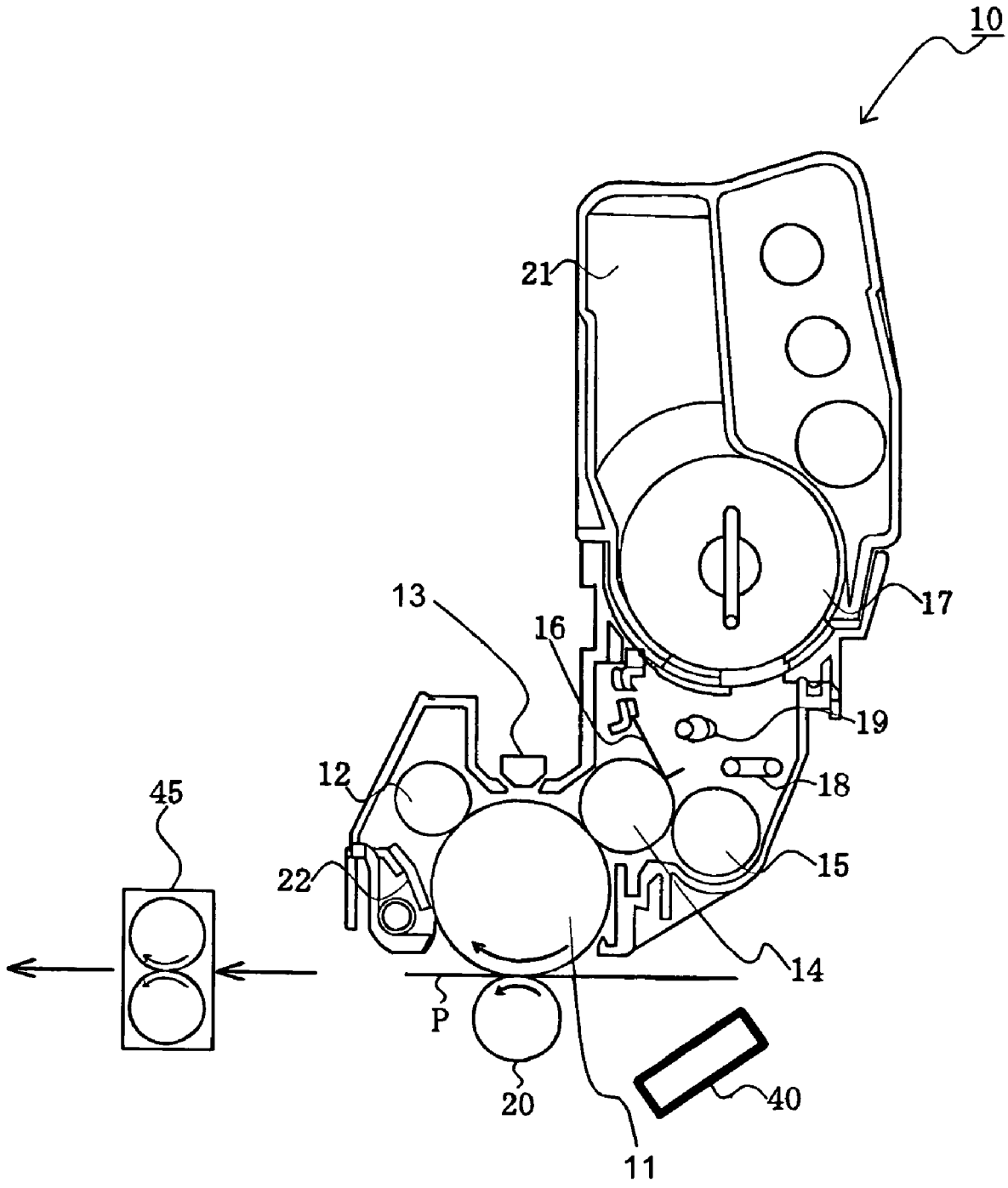
FIG. 1 is a schematic sectional view showing an image forming unit according to a first embodiment of the present invention.
Figure 2:
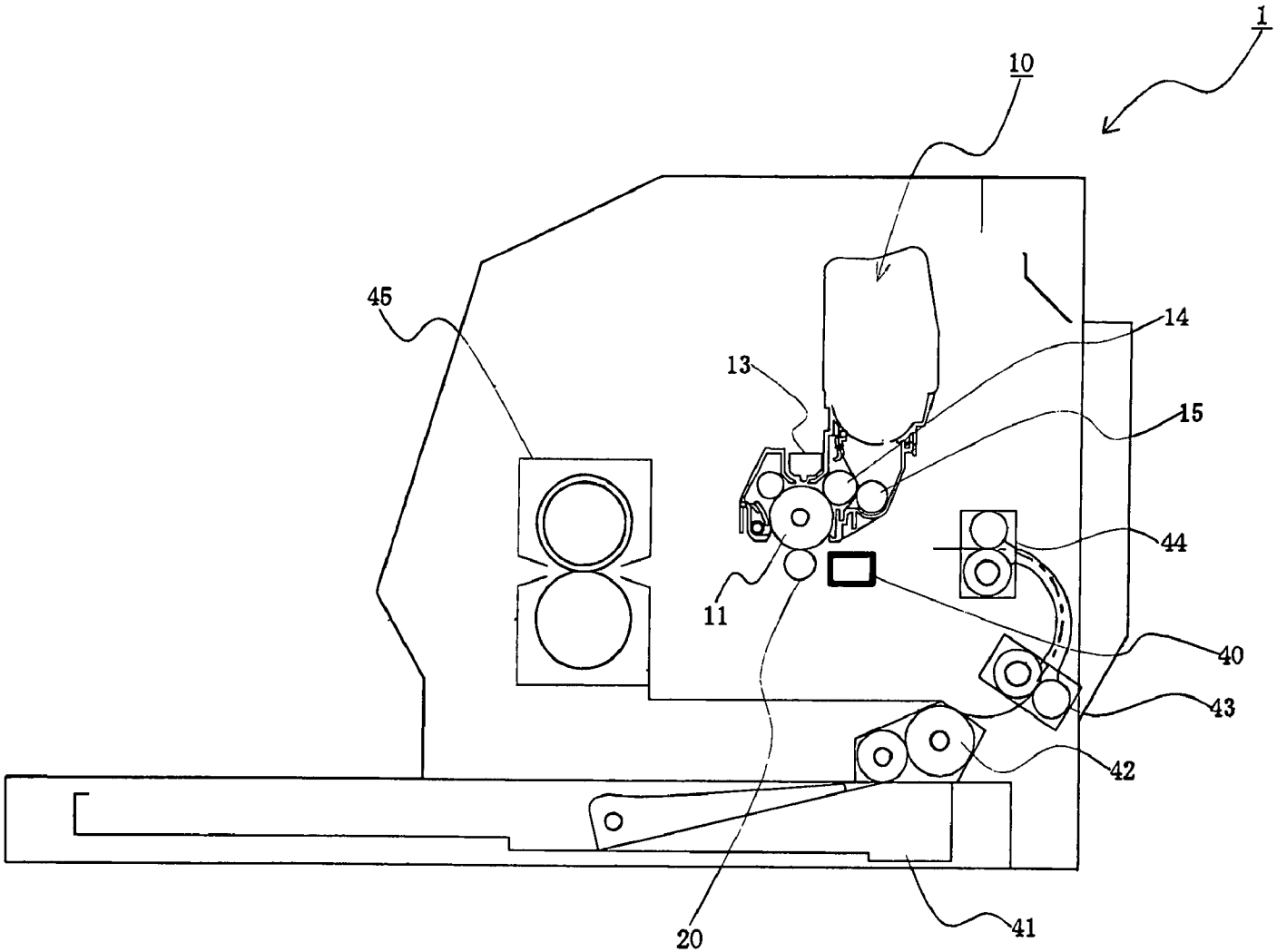
FIG. 2 is a schematic sectional view showing an image forming apparatus according to the first embodiment of the present invention.

A first embodiment of the present invention will be explained. FIG. 1 is a schematic sectional view showing an image forming unit 10 according to the first embodiment of the present invention. FIG. 2 is a schematic sectional view showing an image forming apparatus 1 according to the first embodiment of the present invention.

In the embodiment, the image forming apparatus 1 may be a printer, a copier, a facsimile, a multifunction product, and the likes. In the following description, the image forming apparatus 1 is a printer of an electro-photography type for forming an image with an electro-photography method. Further, the image forming apparatus 1 is the printer for forming a monochrome image, and may be a printer for forming a color image.

In the embodiment, the image forming apparatus 1 is provided with a tray 41 for storing a recording medium P as a medium, the image forming unit 10, and a fixing device 45. As shown in FIG. 2, a hopping roller 42 is provided for picking up the recording medium P from the tray 41. A register roller pair 43 is provided for transporting the recording medium P with a skew. A register roller pair 44 is provided for transporting the recording medium P.

In the embodiment, the recording medium P is set in the tray 41 in a laminated state, and the hopping roller 42 transports the recording medium P in a separated state one by one to the register roller pair 43 and the register roller pair 44. Then, the register roller pair 43 and the register roller pair 44 send the recording medium P at a specific timing, and a toner image formed with the image forming unit 10 is transferred to the recording medium P.

When the recording medium P is transported into the fixing device 45, the fixing device 45 performs a fixing process, thereby fixing the toner image on the recording medium P. After the toner image is fixed to the recording medium P, the recording medium P is discharged outside the image forming apparatus 1.

As shown in FIG. 1, the image forming unit 10 includes a photosensitive drum 11 as an image supporting member to be rotatable at a specific rotational speed. The photosensitive drum 11 is capable of accumulating charges on a surface thereof, and removing the charges on the surface thereof. A charge roller 12 is pressed against the surface of the photosensitive drum 11 with a specific pressure as a charge member for applying a specific voltage. The charge roller 12 is capable of rotating in a direction same as that of the photosensitive drum 11.

In the embodiment, a light source 13 is disposed above the photosensitive drum 11 as an exposure device for forming a static latent image on the surface of the photosensitive drum 11. A toner cartridge 21 is disposed above the photosensitive drum 11 as a developer storage portion for storing toner 17 as developer. A stirring member 19 is provided for stirring the toner 17 supplied from inside the toner cartridge 21, and a toner transportation member 18 is provided as a developer transportation member for transporting the toner 17 to a toner supply roller 15 as a developer supply member.

In the embodiment, the toner supply roller 15 is pressed against a developing roller 14 or a developer supporting member with a specific pressure. A developer blade 16 is provided for regulating the toner 17 supplied to the developing roller 14 with the toner supply roller 15 at a specific thickness. The developing roller 14 is pressed against the photosensitive drum 11 with a specific pressure, so that the static latent image formed on the photosensitive drum 11 with the light source 13 is developed with the toner 17.

In the embodiment, a transfer roller 20 is disposed under the photosensitive drum 11 as a transfer member. A power source (not shown) applies a voltage to the transfer roller 20, so that the transfer roller 20 transfers the toner image formed on the photosensitive drum 11 to the recording medium P. A density sensor 40 is provided for detecting a density of a patch pattern (described later) formed on the photosensitive drum 11 as a density detection pattern, so that a control table (described later) of a developing bias is changed.

Figure 3:
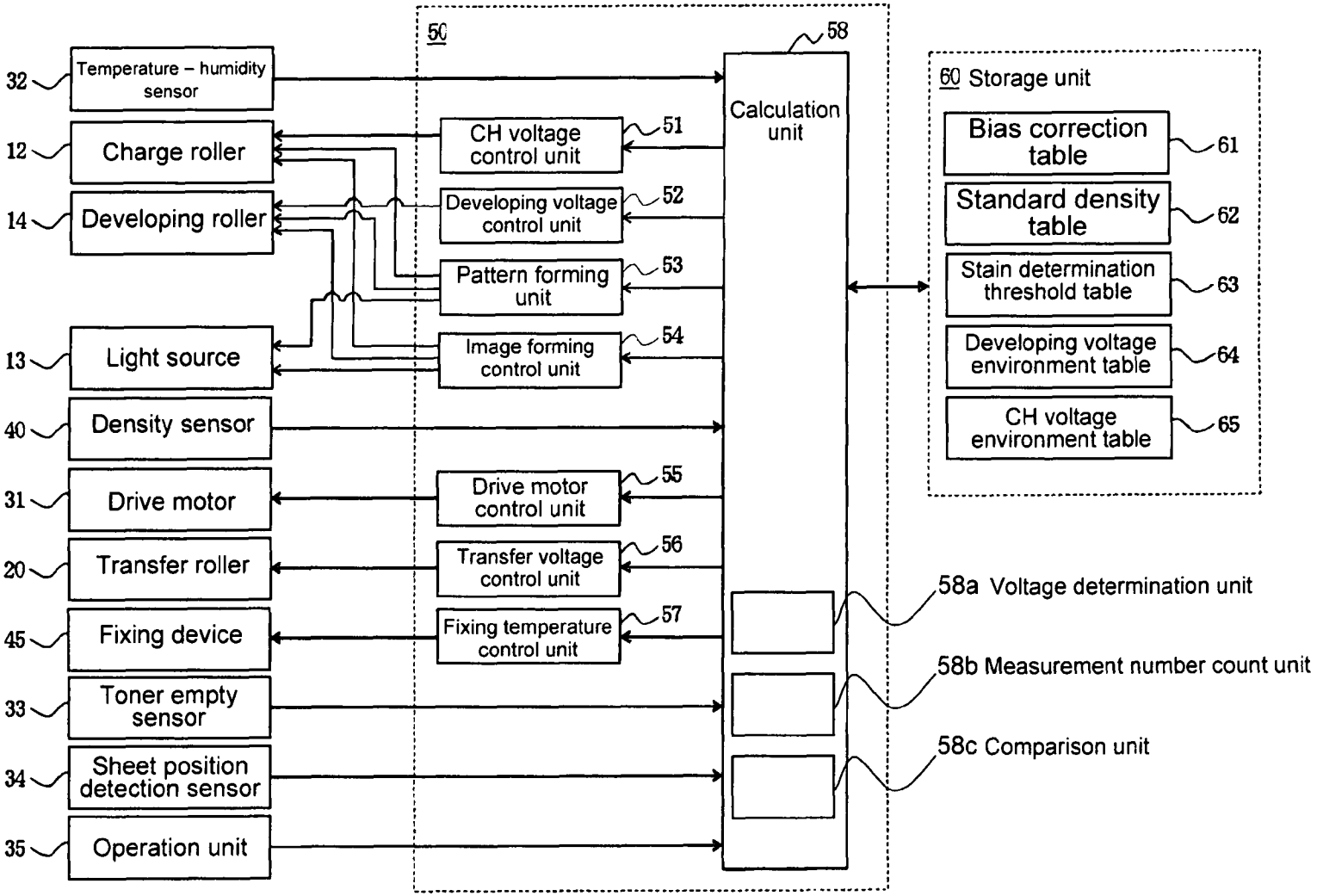
FIG. 3 is a block diagram showing a control system of the image forming apparatus according to the first embodiment of the present invention.

A control system of the image forming apparatus 1 will be explained next. FIG. 3 is a block diagram showing the control system of the image forming apparatus 1 according to the first embodiment of the present invention.

As shown in FIG. 3, the control system of the image forming apparatus 1 includes an image control unit 50 for controlling an image forming condition. The image control unit 50 includes a calculation unit 58 for calculating according to data from an input unit; a CH voltage control unit 51 for controlling an output unit according to a calculation result; a developing voltage control unit 52; a pattern forming unit 53; an image forming control unit 54; a drive motor control unit 55; a transfer voltage control unit 56; and a fixing temperature control unit 57.

In the embodiment, the image control unit 50 is connected to an operation unit 35 as the input unit for displaying a state of the image forming apparatus 1 and reflecting a direction of an operator; a toner empty sensor 33 for monitoring an operation status of the image forming apparatus 1; a temperature-humidity sensor 32; a sheet position detection sensor 34; and the density sensor 40 for detecting a toner density and a density of a patch pattern.

As shown in FIG. 3, the calculation unit 58 includes a voltage determination unit 58*a*; a measurement number count unit 58*b*; and a comparison unit 58*c*. The calculation unit 58 performs calculations according to data from the input unit and various tables stored in a storage unit 60 for controlling the CH voltage control unit 51, the developing voltage control unit 52, the pattern forming unit 53, the image forming control unit 54, the drive motor control unit 55, the transfer voltage control unit 56, and the fixing temperature control unit 57.

As shown in FIG. 3, the storage unit 60 includes a bias correction table 61; a standard density table 62; a stain determination threshold table 63; a developing voltage environment table 64; and a CH voltage environment table 65. The bias correction table 61 is determined through an experiment for adjusting a bias to obtain a specific density. The standard density table 62 is provided for determining a density when a specific voltage is applied. The developing voltage environment table 64 is provided for determining a value of the density sensor 40 considered as a stain. The developing voltage environment table 64 and the CH voltage environment table 65 are provided for correcting voltages according to an environment.

In the embodiment, the image control unit 50 as an output unit controls the charge roller 12, the developing roller 14, the light source 13, a drive motor 31, the transfer roller 20, and the fixing device 45.

An operation of the image forming apparatus 1 will be explained next.

First, the charge roller 12 charges the photosensitive drum 11, and the light source 13 radiates light on the photosensitive drum 11 to form the static latent image on the photosensitive drum 11. Then, the developing roller 14 visualizes or develops the static latent image formed on the photosensitive drum 11 to form the toner image, and the toner image is transferred to the recording medium P. After the toner image is transferred, a cleaning blade 22 scrapes off the toner 17 remaining on the photosensitive drum 11.

In the embodiment, the image forming apparatus 1 performs developing with a one-component developing method, and the toner 17 is used as a one-component developer. An opening portion is formed in a lower portion of the toner cartridge 21 to be freely opened and closed. When the opening portion is opened, the toner 17 retained inside the toner cartridge 21 drops by a specific amount through the opening portion and is supplied into a developing unit as a developing device. In the developing unit, the stirring member 19 rotates to stir and supply the toner 17 to the toner supply roller 15.

In the embodiment, the toner supply roller 15 rotates while sliding against the developing roller 14 in a direction opposite to that of the developing roller 14 at a circumferential speed having a specific difference relative to that of the developing roller 14. Accordingly, the toner supply roller 15 supplies the toner 17 to the developing roller 14 according to a potential difference between the toner supply roller 15 and the developing roller 14. At the same time, the toner supply roller 15 scrapes off the toner 17 remaining on an outer circumferential surface of the developing roller 14.

Note that the toner supply roller 15 is formed of a foamed elastic member such as a foamed member of silicone rubber and the likes, and a plurality of cells (not shown) formed of recessed portions is formed in a surface of the toner supply roller 15.

While the developing roller 14 is rotating, the toner 17 on the developing roller 14 is transported to the developer blade 16. After the developer blade 16 regulates a thickness of a toner layer, the toner 17 is transported to a developing area facing the photosensitive drum 11. In the developing area, the static latent image on the photosensitive drum 11 attracts the toner 17 through static electricity, so that the toner 17 moves to the photosensitive drum 11, thereby forming the toner image on the photosensitive drum 11.

After the toner image is formed on the photosensitive drum 11, the toner image is transferred to the recording medium P at a transfer portion facing the transfer roller 20. Afterward, the recording medium P is transported to the fixing device 45, and the fixing device 45 fixes the toner image on the recording medium P. After the toner image is fixed, the cleaning blade 22 scrapes off the toner 17 remaining on the photosensitive drum 11. Then, the next image forming process starts.

Figure 4:
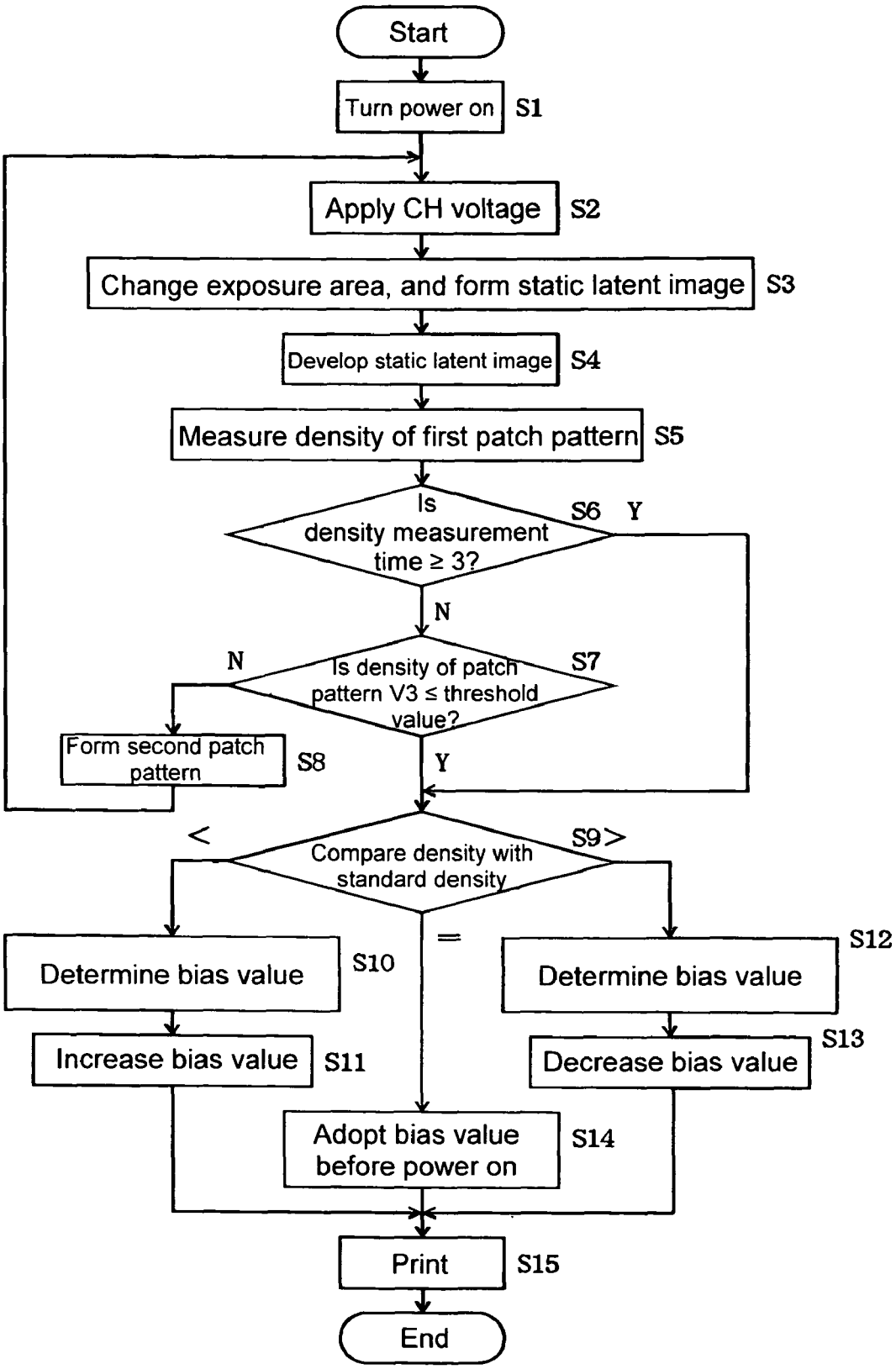
FIG. 4 is a flow chart showing an operation of the image forming apparatus according to the first embodiment of the present invention.
Figure 5:
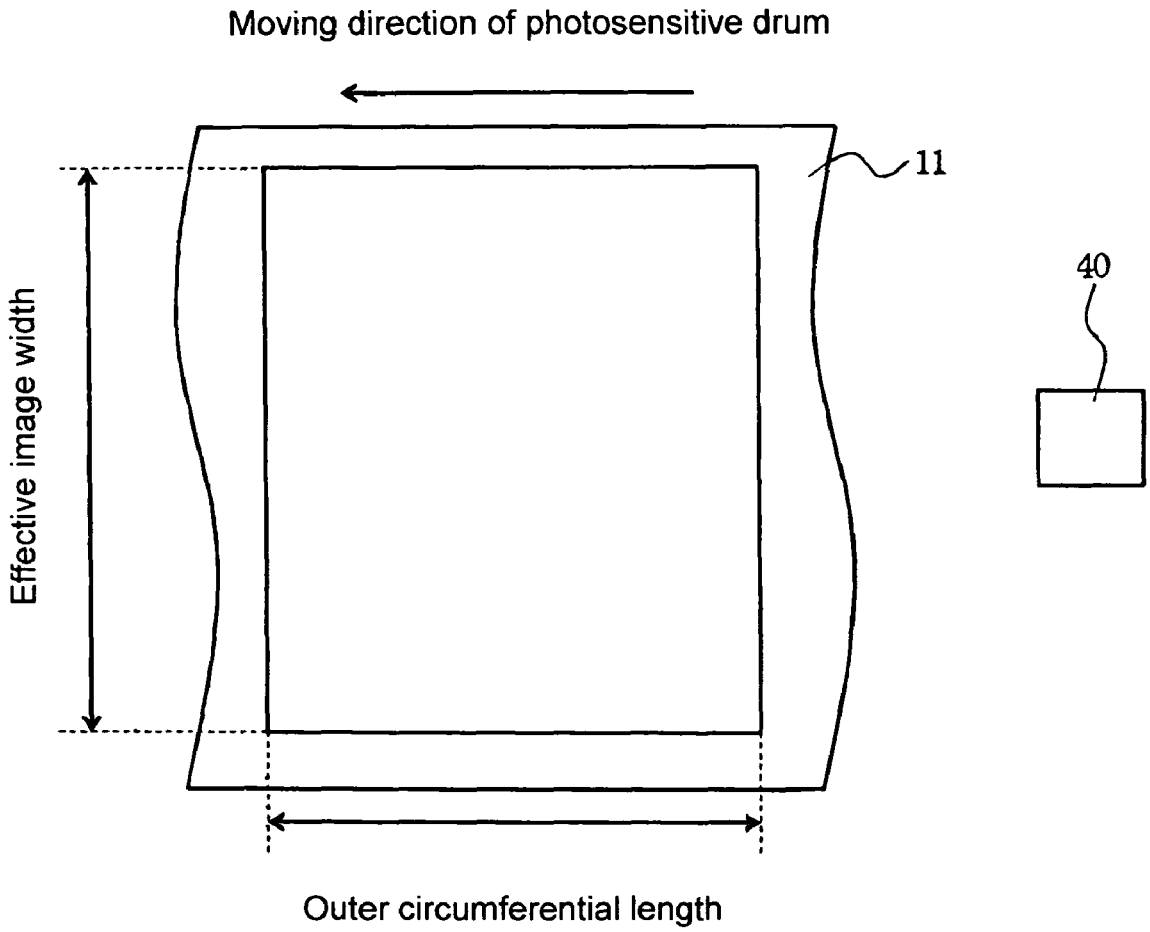
FIG. 5 is a schematic view showing a second patch pattern according to the first embodiment of the present invention.
Figure 6:
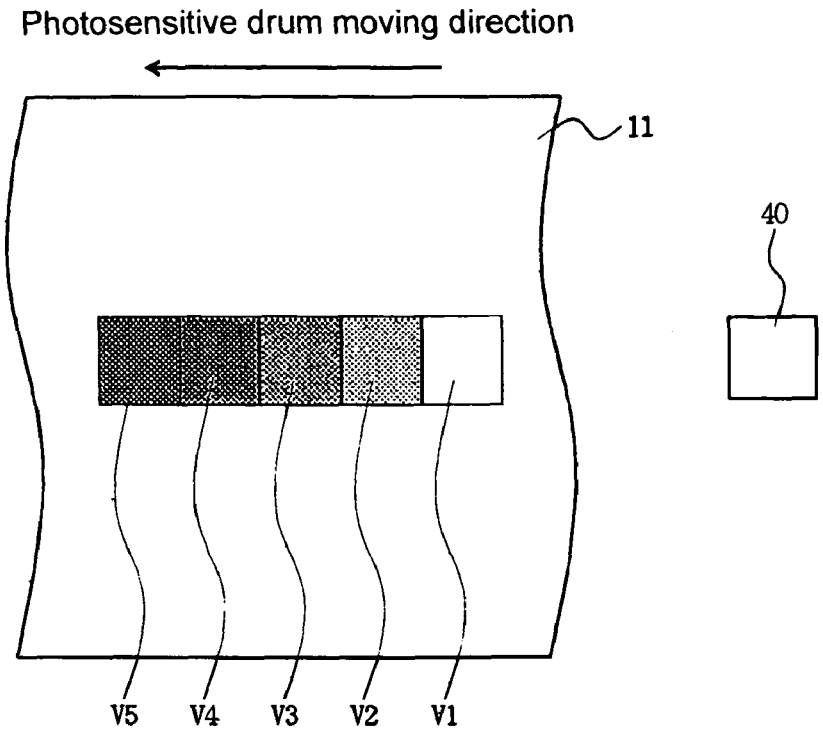
FIG. 6 is a schematic view showing a first patch pattern according to the first embodiment of the present invention.

An operation of density correction will be explained next. FIG. 4 is a flow chart showing an operation of the image forming apparatus according to the first embodiment of the present invention. FIG. 5 is a schematic view showing a second patch pattern according to the first embodiment of the present invention. FIG. 6 is a schematic view showing a first patch pattern according to the first embodiment of the present invention.

In the embodiment, the image forming apparatus 1 performs the operation of the density correction at the following timings:

when the image forming apparatus 1 is turned on (power on), when the image forming unit 10 (ID; Image Drum) is replaced with a new one, and when the image forming apparatus 1 prints on more than 500 sheets (as A-4 size) after the density correction is performed.

When the image forming apparatus 1 is turned on, a voltage supply unit (not shown) applies a voltage to the charge roller 12 to charge the photosensitive drum 11. At this moment, the pattern forming unit 53 adjusts an area of the surface (an exposure area) of the photosensitive drum 11 thus exposed with the light source 13 according to patch patterns V1 to V5 of the first patch pattern as a first pattern or a third pattern. Accordingly, a static latent image corresponding to the patch pattern V1 to V5 is formed on the photosensitive drum 11.

In the embodiment, the voltage determination unit 58*a* of the calculation unit 58 determines a charge potential according to a potential environment correction data table. A photosensitive material of the photosensitive drum 11 tends to have various charging abilities according to a temperature. That is, even when a same voltage is applied, a charge potential may be different depending on a temperature. To this end, the potential environment correction data table is used for adjusting the voltage to be applied to the photosensitive material of the photosensitive drum 11 according to a temperature.

For example, the applied voltage is set to 1,010 V under a low temperature environment in which a charging ability becomes low. On the other hand, the applied voltage is set to 980 V under a high temperature environment in which a charging ability becomes high. Accordingly, through adjusting the applied voltage, it is possible to maintain the potential on the photosensitive drum 11 constant.

Similarly, it is necessary to adjust the developing bias according to an environment such as a change in a resistivity of the developing roller 14, a change in a charging property of the toner 17, and the likes. For example, when humidity is high, the toner 17 tends to absorb moisture and have a lower resistivity, thereby changing the charging property of the toner 17. To this end, the potential environment correction data table is preferably provided for adjusting the charged potential of the photosensitive drum 11 and the developing bias at optimal values under various environments determined in advance.

In the embodiment, as described above, the calculation unit 58 controls the light source 13 to form the patch patterns V1 to V5 through changing the exposure area.

In the embodiment, it is configured such that the patch pattern V5 has a density of 100%; the patch pattern V4 has a density of 70%; the patch pattern V3 has a density of 50%; the patch pattern V2 has a density of 30%; and the patch pattern V1 has a density of 10%. For example, when the patch pattern V5 has a density of 100%, the light source 13 turns on all the time. When the patch pattern V3 has a density of 50%, the light source 13 repeats on and off alternately. Accordingly, through adjusting on/off of the light source 13, the patch patterns V1 to V5 have different densities. Note that an exposure amount of the light source 13 remains constant regardless of an environment and the likes.

In the embodiment, the first patch pattern is formed of various types of patterns, i.e., the patch patterns V1 to V5, for adjusting gradation. That is, the densities of the patch patterns V1 to V5 are measured. When the gradation is not proper, the developing bias and the exposure amount of the light source 13 are adjusted.

In the embodiment, only the patch pattern V3 is used for automatic density correction. Accordingly, it is easy to determine a stain due to a middle density printing. A stain is caused due to an abnormally thick layer of the toner 17 on the developing roller 14, where a larger amount of the toner 17 adheres to the photosensitive drum 11 than a normal amount, thereby causing a difference in densities. Accordingly, when a high-duty printing or a high-density printing is performed while a stain occurs, a large amount of the toner 17 on the developing roller 14 moves to the photosensitive drum 11.

For example, it is supposed that a normal amount of the toner 17 on the developing roller 14 is 0.45 g/cm$^2$, and an amount of the toner 17 at a stain is 0.65 g/cm$^2$. When the high-density printing, for example 100%, is performed, 0.40 g/cm$^2$ of the toner 17 moves from a normal portion, and 0.60 g/cm$^2$ of the toner 17 moves from the stain. That is, in a normal case, 0.40 g/cm$^2$ of the toner 17 moves to the photosensitive drum 17 from the developer roller, where 0.45 g/cm$^2$ of the toner 17 is attached. When a stain exists, 0.60 g/cm$^2$ of the toner 17 moves to the photosensitive drum 17 from the developer roller, where 0.65 g/cm$^2$ of the toner 17 is attached.

On the other hand, when a middle-density printing, for example 50%, is performed, 0.05 g/cm$^2$ of the toner 17 moves from a normal portion, and 0.25 g/cm$^2$ of the toner 17 moves from the stain. That is, in a normal case, 0.05 g/cm$^2$ of the toner 17 moves to the photosensitive drum 17 from the developer roller, where 0.45 g/cm$^2$ of the toner 17 is attached. When a stain exists, 0.25 g/cm$^2$ of the toner 17 moves to the photosensitive drum 17 from the developer roller, where 0.65 g/cm$^2$ of the toner 17 is attached.

A difference in the amounts of the toner 17 on the photosensitive drum 11 between the high-density printing and the middle-density printing is the same. However, on the recording medium P, a normal portion has a density of 1.2 and a stain has a density of 1.4 in the case of the high-density printing, and the normal portion has a density of 0.1 and the stain has a density of 0.6 in the case of the middle-density printing.

As described above, on the recording medium P, a difference between the density of the normal portion and that of the stain in the case of the high-density printing becomes smaller than that in the middle-density printing. Accordingly, it is easy to determine the stain in the middle-density printing.

In the next step, the static latent image on the photosensitive drum 11 is developed. At this time, the voltage determination unit 58*a* determines the developing bias applied to the developing roller 14 and a sponge bias applied to the toner supply roller 15 with a voltage supply portion (not shown) according to an environment upon turning on the image forming apparatus 1.

When the environment changes, the toner 17 is charged in different ways depending on a parameter such as a change in the charging property of the toner 17, a change in a nip pressure between the developing roller 14 and the photosensitive drum 11, and the likes. For example, when humidity is high, the toner 17 tends to absorb moisture and have a lower resistivity, thereby making it difficult to charge the toner 17. Further, the developing roller 14 and the photosensitive drum 11 shrink or expand due to changes in a temperature and humidity, thereby changing the nip pressure. Accordingly, under a high-temperature and high-humidity environment, the density tends to increase. Under a low-temperature and low-humidity environment, the toner 17 tends to have a higher potential, thereby causing a stain.

In the embodiment, to this end, optimal values of the developing bias and the sponge bias are determined in advance through an experiment, and a correction table is prepared. Then, an environmental value is measured with the temperature-humidity sensor 32 for determining the developing bias and the sponge bias according to the correction table.

As described above, through the operation, the first patch pattern shown in FIG. 6 is formed on the photosensitive drum 11.

In the next step, the density sensor 40 measures a density of the pattern thus developed, i.e., the first patch pattern. Then, the measurement number count unit 58*b* of the calculation unit 58 checks a number of the density measurements to determine whether the density measurement number is equal to or exceeds three times.

When it is determined that the density measurement number is equal to or exceeds three times, the comparison unit 58*c* of the calculation unit 58 compares the density with a standard density. When it is determined that the density measurement number does not exceed three times, that is, less than three times, the density of the patch pattern V3 of the first patch pattern is compared with a threshold value to determine whether the density of the patch pattern V3 is equal to or less than the threshold value.

When the density of the patch pattern V3 is more than the threshold value, that is, exceeds the threshold value, the pattern forming unit 53 forms the second patch pattern as a second pattern. Accordingly, the toner 17 is discarded, and the density is measured one more time. In the embodiment, the toner 17 is discarded using the second patch pattern having a density of 100%, and not limited thereto. The second patch pattern may have a density of 60 to 100%. When the second patch pattern has a density of less than 60%, it is difficult to efficiently discard the toner 17.

As shown in FIG. 5, the second patch pattern has a width same as an effective developing width or an effective image width. Further, the second patch pattern has a length in a longitudinal direction thereof greater than an outer circumferential length of either of the developing roller 14 or the toner supply roller 15, which is longer than the other.

When the density of the patch pattern V3 is equal to or less than the threshold value, the comparison unit 58*c* compares the density with the standard density. More specifically, the comparison unit 58*c* compares the density of the patch pattern V3 with the standard density table 62 stored in advance.

In the embodiment, the density sensor 40 measured a density of the toner 17 on the photosensitive drum 11 in advance at various developing biases, thereby obtaining the standard density table 62. Further, when a stain occurs, the density sensor 40 measures a density of the stain in advance to determine a density difference. Accordingly, is it possible to correlate the density of the stain to the density difference in advance. Then, the standard density and the threshold value at each developing bias are determined through adding the density difference when a stain occurs in each measurement value in the standard density table 62 to the density difference, thereby obtaining the table.

When the density of the patch pattern V3 is greater than the standard density, the comparison unit 58*c* compares the density with the values stored in advance, and the voltage determination unit 58*a* determines the bias value. More specifically, an optimal bias value is determined with reference to the bias correction table 61. After the developing bias is decreased, the printing operation is performed.

When the density of the patch pattern V3 is smaller than the standard density, the comparison unit 58*c* compares the density with the values stored in advance, and the voltage determination unit 58*a* determines the bias value. More specifically, an optimal bias value is determined with reference to the bias correction table 61. After the developing bias is increased, the printing operation is performed.

For example, when the density of the patch pattern V3 is smaller than the standard density, it is possible to control the density through increasing or decreasing the developing bias, thereby increasing or decreasing the developing bias to obtain the density determined in advance. Accordingly, a change in the density associated with the increase or decrease in the developing bias is measured in advance, and the bias correction table 61 is prepared.

In the embodiment, the bias correction table 61 is provided such that the density correction number becomes minimum. Alternatively, the measurement and the bias adjustment may be repeated until the density becomes the standard density, and the bias value is determined when the density is equal to the standard density. Further, when the density of the patch pattern V3 is equal to the standard density, the voltage determination unit 58*a* adopts the developing bias value at power on, and the printing operation is performed.

The flow chart shown in FIG. 4 will be explained next. In step S1, power is turned on. In step S2, the voltage (a CH voltage) is applied to the charge roller 12. In step S3, the exposure area is changed, and the static latent image of the patch patterns V1 to V5 is formed. In step S4, the static latent image is developed.

In step S5, the density sensor 40 measures the density of the first patch pattern thus developed. In step S6, it is determined whether the density measurement number is equal to or greater than three times. When it is determined that the density measurement number is equal to or greater than three times, the process proceeds to step S9. When the density measurement number is equal to or less than two times, the process proceeds to step S7.

In step S7, it is determined whether the density of the patch pattern V3 is equal to or less than the threshold value. When it is determined that the patch pattern V3 is equal to or less than the threshold value, the process proceeds to step S9. When it is determined that the patch pattern V3 is not equal to or less than the threshold value, the process proceeds to step S8.

In step S8, the second patch pattern is formed. In step S9, the density is compared with the standard density. When the density is smaller than the standard density, the process proceeds to step S10. When the density is greater than the standard density, the process proceeds to step S12. When the density is equal to the standard density, the process proceeds to step S14.

In step S10, the density is compared with the value stored in advance to determine the bias value. In step S11, the bias value is increased. In step S12, the density is compared with the value stored in advance to determine the bias value. In step S13, the bias value is decreased. In step S14, the bias value before power on is adopted. In step S15, the printing operation is performed, thereby completing the process.

Figure 7:
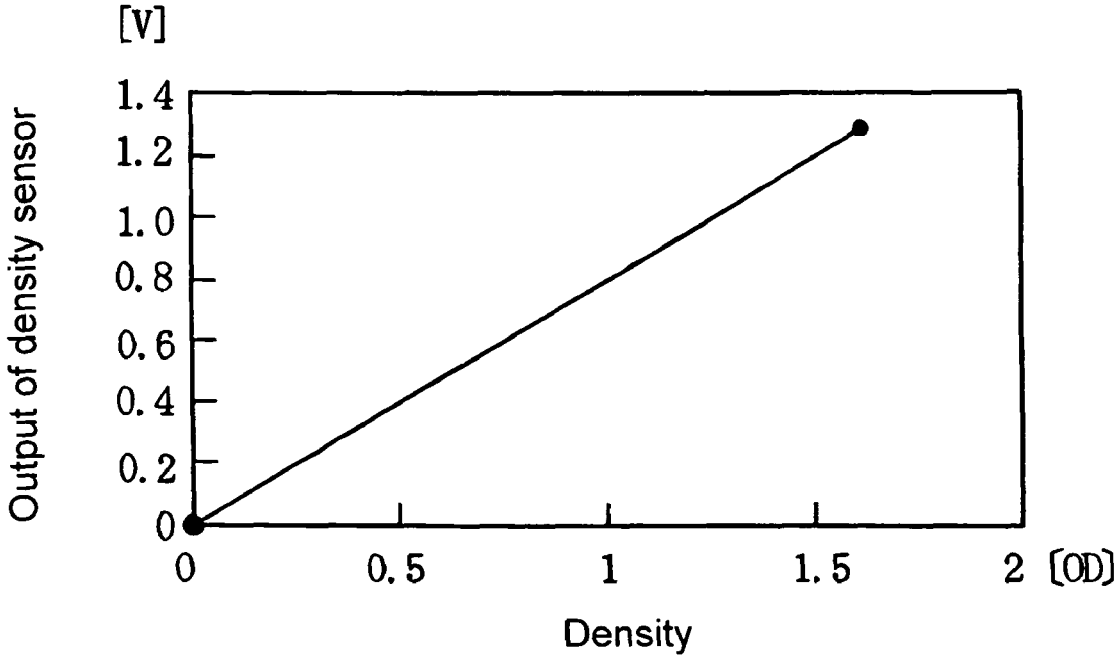
FIG. 7 is a graph showing a relationship between a density of black and an output of a density sensor according to the first embodiment of the present invention.
Figure 8:
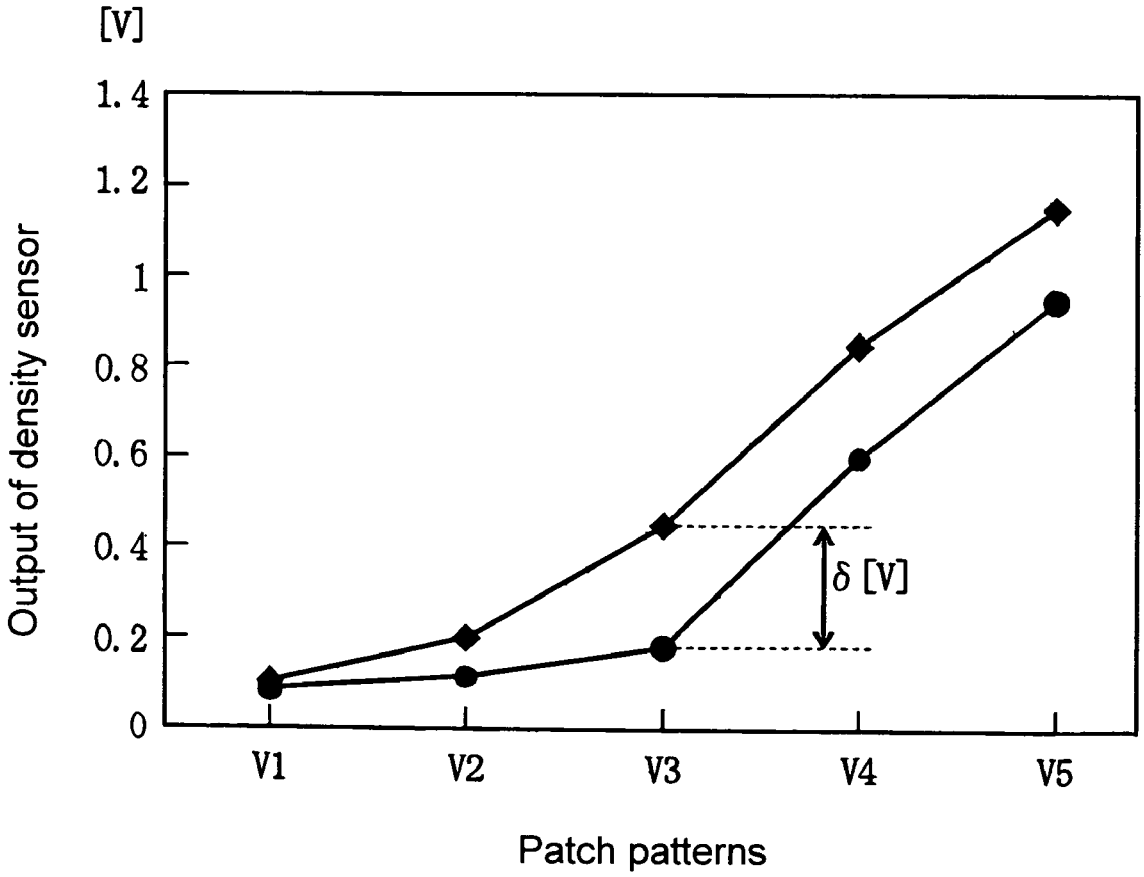
FIG. 8 is a table and a graph showing a relationship between patch patterns V1 to V5 and the output of the density sensor according to the first embodiment of the present invention.

The threshold value to be compared with the density of the patch pattern V3 will be explained next. FIG. 7 is a graph showing a relationship between a density of black and an output of the density sensor 40 according to the first embodiment of the present invention. FIG. 8 is a table and a graph showing a relationship between the patch patterns V1 to V5 and the output of the density sensor 40 according to the first embodiment of the present invention.

In FIG. 7, the horizontal axis represents the density, and the vertical axis represents the output of the density sensor 40. In the graph shown in FIG. 8, the horizontal axis represents the patch patterns V1 to V5, and the vertical axis represents the output of the density sensor 40.

As shown in FIG. 7, the density of black is proportional to the output of the density sensor 40. In the table shown in FIG. 8, the output E, i.e., an example of an output of the density sensor 40 from a pattern to be actually measured, of the density sensor 40 is greater than the standard B. The threshold value δ is defined as a difference between the output of the density sensor 40 and the standard value at the patch pattern V3. When the difference is greater than 0.2 V, it is determined that a stain occurs and the second patch pattern is formed.

As described above, in the embodiment, when it is determined that the density measurement number is equal to or exceeds three times, in other words, the toner 17 is discarded equal to or more than two times, the density correction is performed for the reason explained next.

When the density measurement number is equal to or exceeds three times, it is difficult to improve the stain through discarding the toner 17 any more. If the automatic density correction is performed as is, the developing bias becomes too low. In this case, when a stain occurs, a density other than the stain becomes too low, thereby deteriorating color hue in a color image. Accordingly, it is considered that the developing bias is better maintained.

In the embodiment, it is configured that the automatic density correction is performed, thereby notifying an operator that an image trouble occurs. Further, considering an environment under which the density tends to increase, or a variance in the developing device with which the density tends to increase, it is considered that the automatic density correction is considered more effective in an actual use.

As described above, in the embodiment, the density sensor 40 detects the density of the patch pattern V3 as the density detection pattern. When the density of the patch pattern V3 exceeds the threshold value, it is determined that the toner 17 is deteriorated and the stain occurs. Accordingly, the second patch pattern is formed as a developer discarding pattern, thereby discarding the toner 17 deteriorated. After the toner 17 is discarded, the patch pattern V3 is formed one more time, and the density correction is automatically performed according to the density of the patch pattern V3. Accordingly, it is possible to accurately perform the density correction, and to prevent density abnormality.

Figure 9:
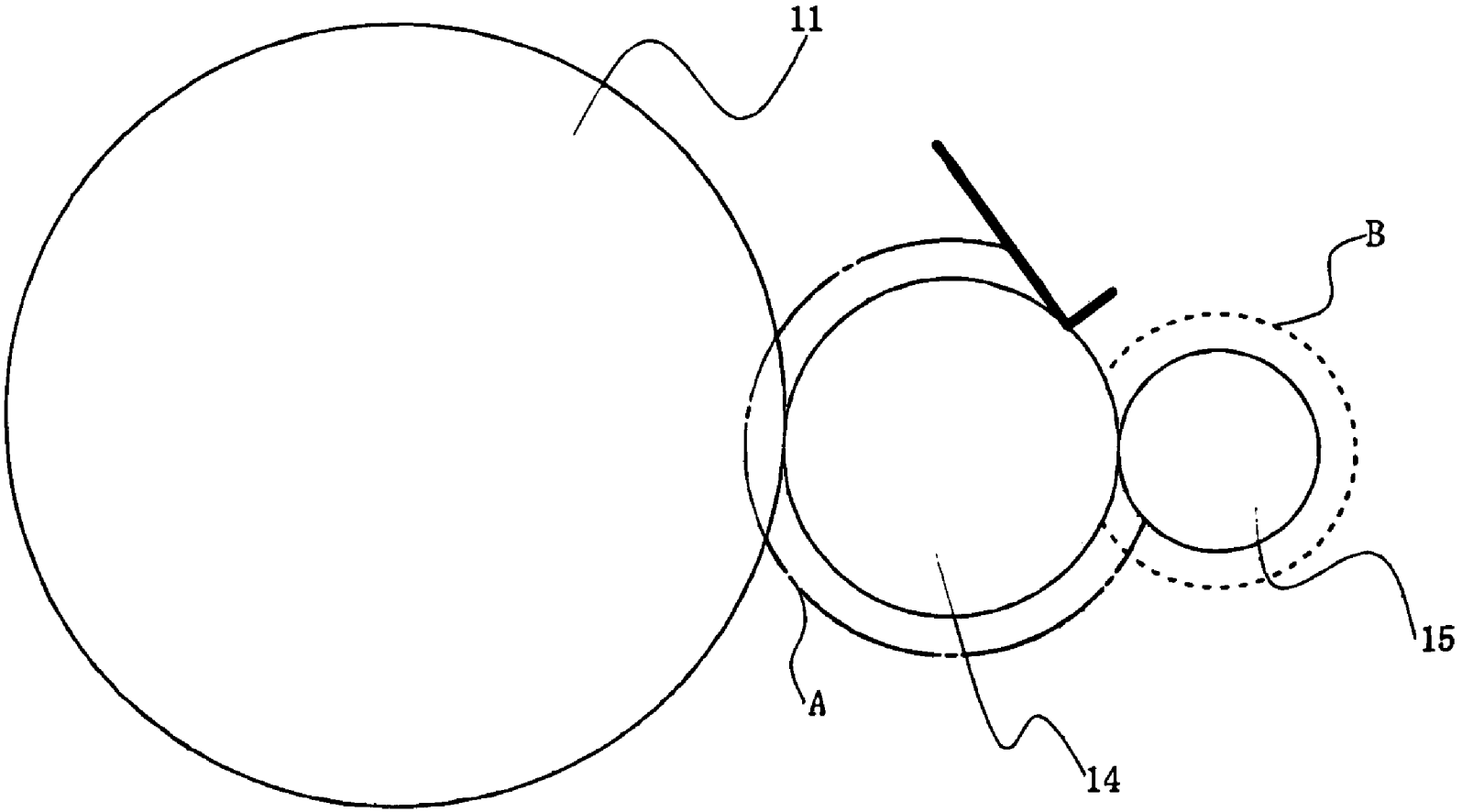
FIG. 9 is a schematic side view of the image forming apparatus for explaining a method of determining a length of the second patch pattern according to the first embodiment of the present invention.

A method of determining a length of the second patch pattern will be explained next. FIG. 9 is a schematic side view of the image forming apparatus 1 for explaining the method of determining the length of the second patch pattern according to the first embodiment of the present invention.

In a case shown in FIG. 9, it is necessary to discard the toner 17 in areas A and B, that is, the toner 17 in the area A charged on the developing roller 14, and the toner 17 in the area B stained on the toner supply roller 15. Accordingly, it is necessary to determine a length of the second patch pattern as the developer discarding pattern according to a range of larger one of the areas A and B. To this end, it is necessary to determine corresponding lengths of the areas A and B on the photosensitive drum 11.

First, circumferential speeds of the developing roller 14, the toner supply roller 15, and the photosensitive drum 11 are determined through the following equation:

$$\text{Circumferential speed} = \text{radius} \times 2 \times 3.14 \times \text{rotations}$$

After the circumferential speed is determined, the areas A and B are divided by the circumferential speeds of the developing roller 14 and the toner supply roller 15 to determine corresponding times. Then, the corresponding times are multiples by the circumferential speed of the photosensitive drum 11, thereby obtaining the corresponding lengths of the areas A and B on the photosensitive drum 11. Accordingly, larger one of the corresponding lengths of the areas A and B is the length necessary for discarding the toner 17, i.e., the length of the second patch pattern.

For example, it is supposed that the photosensitive drum 11 has an outer diameter of 30 mm and rotates at 1637 rps; the developing roller 14 has an outer diameter of 16 mm and rotates at 3888 rps; and the toner supply roller 15 has an outer diameter of 15.5 mm and rotates at 2644 rps. In this case, the circumferential speed of the photosensitive drum 11 is given by:

$$30\times3.14\times1637=154.28 \text{ mm/s}$$

the circumferential speed of the developing roller 14 is given by:

$$16\times3.14\times1637=195.43 \text{ mm/s}$$

and the circumferential speed of the photosensitive drum 11 is given by:

$$15.5\times3.14\times2644=128.74 \text{ mm/s}$$

Accordingly, the lengths of the areas A and B on the developing roller 14 and the toner supply roller 15 are given by:

A: 44.68 mm

B: 48 mm

The lengths of the areas A and B are converted to time as follows:

A: 0.2286 sec.

B: 0.3728 sec.

Accordingly, the lengths of the areas A and B on the photosensitive drum 11 are given by:

A: 35.26 mm

B: 57.5 mm

Accordingly, it is determined that the length of the second pattern should be greater than 57.5 mm.

Note that the stain occurs as an image with a local dark portion when the potential and the amount of the toner 17 on the developing roller 14 increase, and it is difficult to regulate the toner layer with the developer blade 16. The potential and the amount of the toner 17 on the developing roller 14 increase in the following situation.

Figures 10, 11:
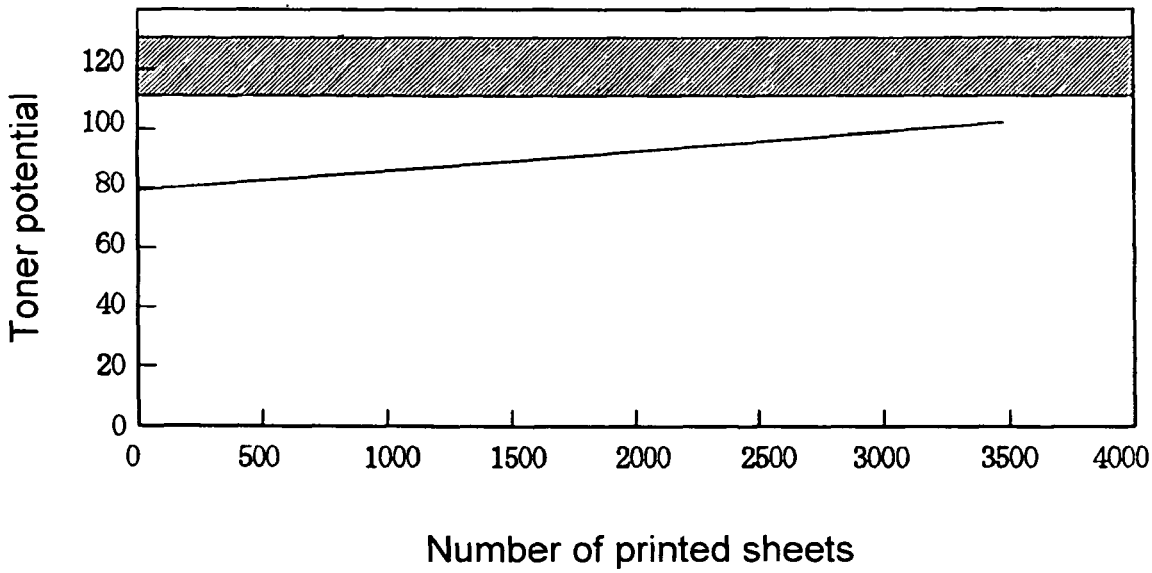
FIG. 10 is a table showing a comparison result of a toner potential and a toner amount of a developing device between placing for a week and after a printing operation according to the first embodiment of the present invention.
FIG. 11 is a graph showing a relationship between a number of printed sheets and the toner potential according to the first embodiment of the present invention.

FIG. 10 is a table showing a comparison result of a toner potential and a toner amount of the developing device between placing for a week and after a printing operation according to the first embodiment of the present invention. FIG. 11 is a graph showing a relationship between a number of printed sheets and the toner potential according to the first embodiment of the present invention. In FIG. 11, the horizontal axis represents the number of printed sheets, and the vertical axis represents the toner potential.

When the developing device is placed for a long period of time, oligomers exude from the toner supply roller 15 and adhere to the toner 17. When the oligomers adhere to the toner 17, the toner 17 tends to charge more easily than normal, so that the potential and the amount of the toner 17 on the developing roller 14 increase.

In general, a surface of the toner supply roller 15 is covered with silicone. Silicone includes a silane monomer, a polymer such as oil, rubber, and a resin, and the oligomer formed of 2 to 10 siloxane units having a medium molecular weight.

FIG. 10 is the table showing the comparison result between the potential and the amount of the toner 17 on the developing roller 14 after the developing device is placed for a week and the potential and the amount of the toner 17 on the developing roller 14 after the printing operation is performed. As shown in FIG. 10, after the developing device is placed for a week, the potential and the amount of the toner 17 are −90 V and 0.6 g/cm$^2$, respectively. After the printing operation is performed, the potential and the amount of the toner 17 are −60 V and 0.4 g/cm$^2$, respectively, clearly smaller than those in the former case.

As described above, the potential and the amount of the toner 17 on the developing roller 14 increase due to the oligomers adhering to the toner supply roller 15. Accordingly, when the toner 17 stained with the oligomers is discarded, the potential and the amount of the toner 17 decrease, thereby preventing the stain of the toner 17.

When a remaining amount of the toner 17 in the developing device becomes small, and the toner 17 is not consumed to a large extent, the toner 17 is repeatedly charged between the developing roller 14 and the developer blade 16. In this case, when a low-duty printing operation is performed, the potential and the amount of the toner 17 on the developing roller 14 increase.

As shown in FIG. 11, the toner potential is −80 V at the initial stage. After 3,500 sheets are printed in the low-duty printing operation, the toner potential increases to −100 V. Especially, when the printing operation is continued, the outer diameter of the toner supply roller 15 decreases. Accordingly, the toner supply roller 15 scrapes off the toner 17 from the developing roller 14 with a lower force, thereby making this phenomenon more apparent.

When the high-density printing operation is performed, the toner 17 on the developing roller 14 moves to the photosensitive drum 11 and is replaced with new toner. Accordingly, the toner potential on the developing roller 14 decreases, thereby eliminating the stain.

As described above, when the stain occurs, the toner 17 is discarded, thereby improving an image. In the description above, the image forming apparatus 1 is the monochrome printer, and may be a full color printer.

As described above, in the embodiment, when the density of the patch pattern V3 detected with the density sensor 40 exceeds the threshold value, it is determined that the toner 17 is stained. Then, the second patch pattern is formed to discard the toner 17 thus deteriorated or stained with the oligomers and the toner 17 with a high potential on the developing roller 14. Accordingly, the density of the patch pattern V3 formed one more time becomes normal. The density correction is performed according to the density of the patch pattern V3, thereby preventing density abnormality.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 12:
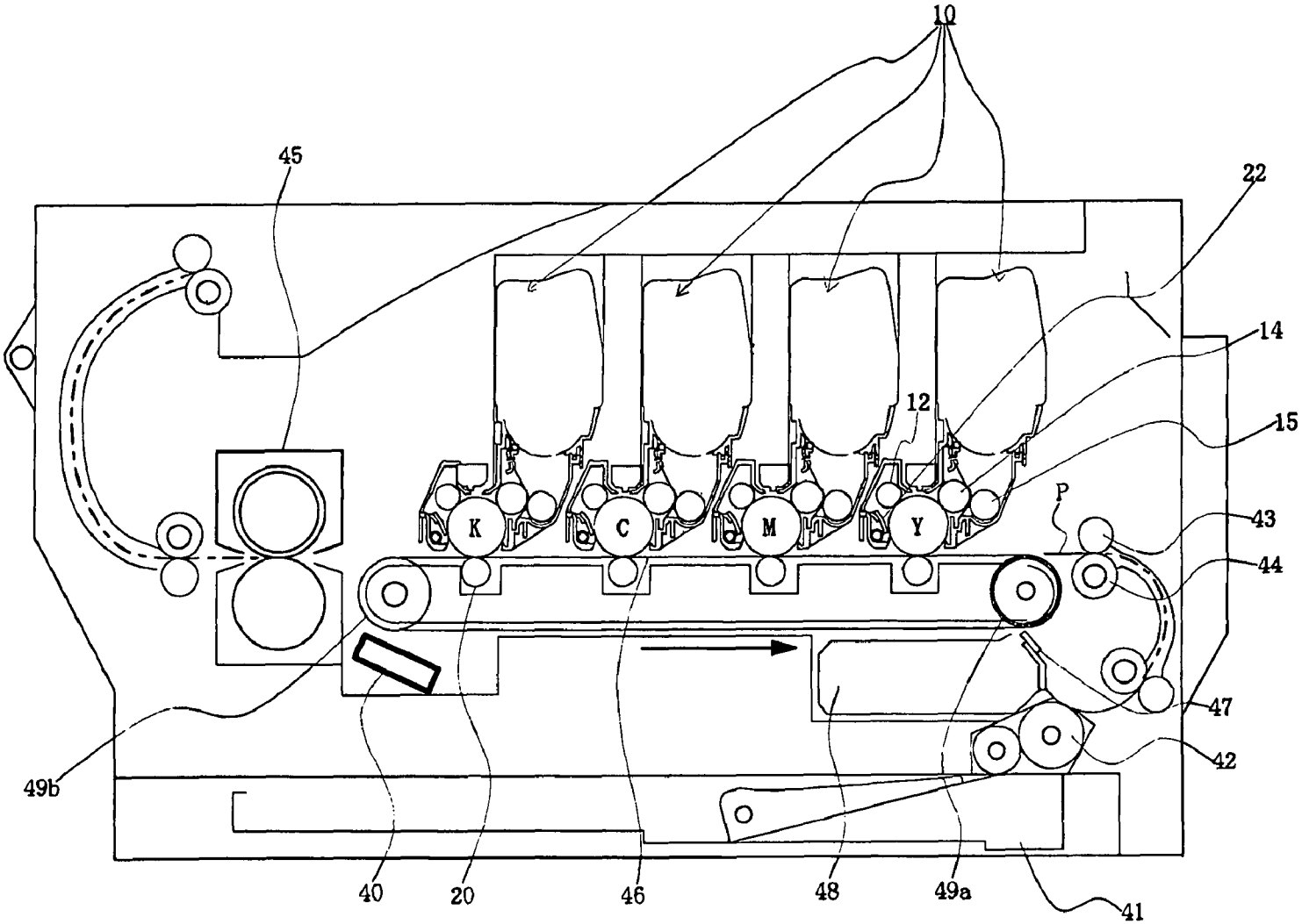
FIG. 12 is a schematic sectional view showing an image forming apparatus according to a second embodiment of the present invention.

FIG. 12 is a schematic sectional view showing the image forming apparatus 1 according to the second embodiment of the present invention.

As shown in FIG. 12, the image forming apparatus 1 is provided with four image forming units 10 arranged in a transportation direction of the recording medium P for forming toner images using the toner 17 in yellow, magenta, cyan, and black, respectively. The image forming units 10 are arranged in tandem, thereby forming a color image.

In the embodiment, a transfer belt 46 and the transfer rollers 20 are disposed under the photosensitive drum 11 as an intermediate transfer member. A power source (not shown) applies a voltage to the transfer belt 46 and the transfer rollers 20 for transferring the toner image to the recording medium P.

When the recording medium P is not transported due to a sheet supply problem, and the toner 17 adheres to the transfer belt 46, a transfer belt cleaning device 47 removes the toner 17. The toner 17 thus removed is collected in a toner collection container 48. An idle roller 49*a* is provided for stabilizing the transfer belt 46, and a drive roller 49*b* is provided for driving the photosensitive drum 11.

Figure 13:
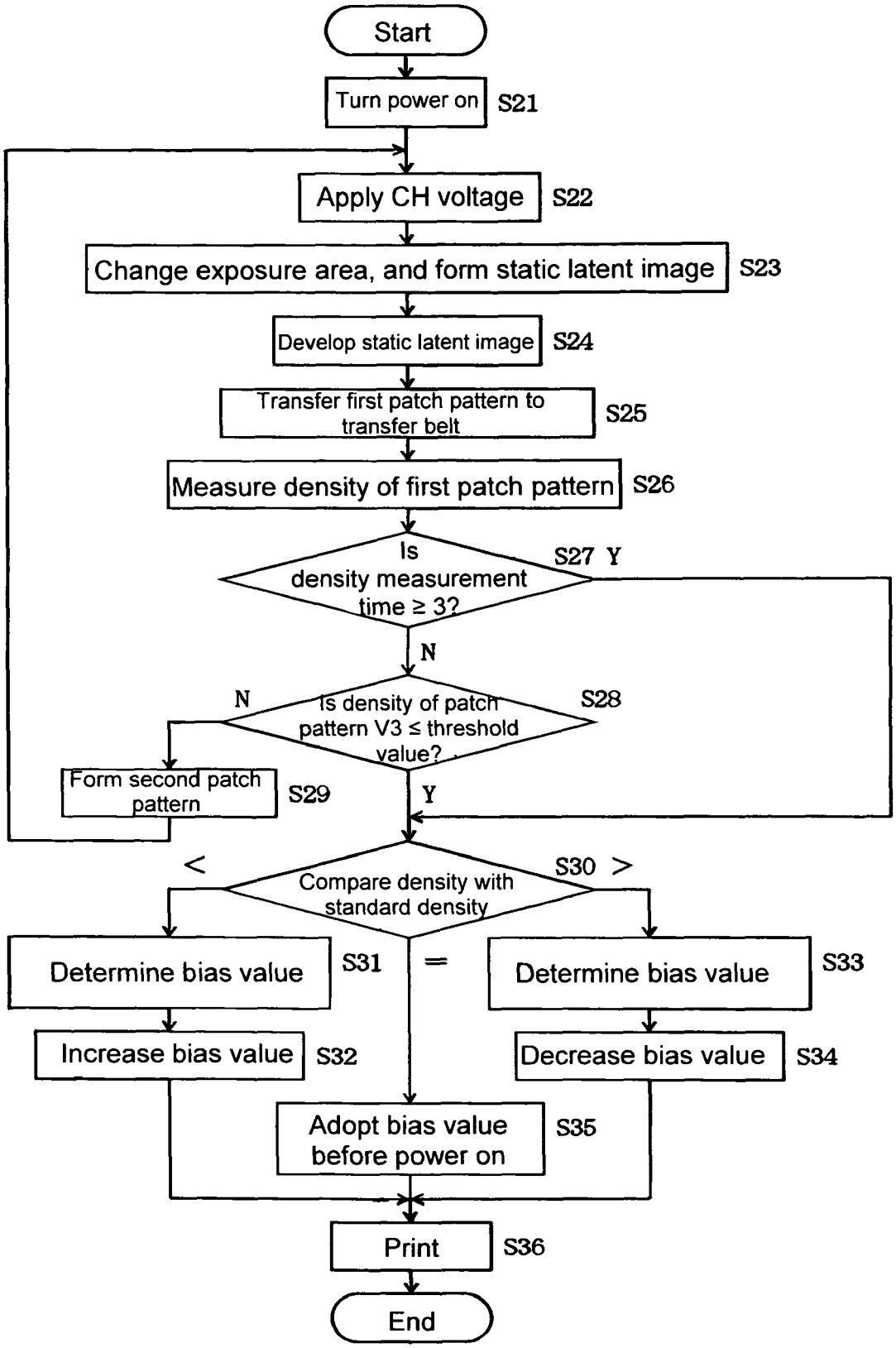
FIG. 13 is a flow chart showing an operation of the image forming apparatus according to the second embodiment of the present invention.

An operation of the image forming apparatus 1 will be explained next. An operation of the density correction will be explained first. FIG. 13 is a flow chart showing the operation of the image forming apparatus 1 according to the second embodiment of the present invention.

When the image forming apparatus 1 is turned on, a voltage supply unit (not shown) applies a voltage to the charge roller 12 to charge the photosensitive drum 11. At this moment, the voltage determination unit 58*a* determines a charge potential according to a potential environment correction data table. Then, the light source 13 changes the exposure area in the patch patterns V1 to V5.

In the embodiment, it is configured such that the patch pattern V5 has a density of 100%; the patch pattern V4 has a density of 70%; the patch pattern V3 has a density of 50%; the patch pattern V2 has a density of 30%; and the patch pattern V1 has a density of 10%. For example, when the patch pattern V5 has a density of 100%, the light source 13 turns on all the time. When the patch pattern V3 has a density of 50%, the light source 13 repeats on and off alternately. Note that the calculation unit 58 determines an exposure amount of the light source 13 according to an environment when the image forming apparatus 1 is turned on.

In the next step, the static latent image on the photosensitive drum 11 is developed. At this time, the voltage determination unit 58*a* determines the developing bias applied to the developing roller 14 and the sponge bias applied to the toner supply roller 15 according to an environment upon turning on the image forming apparatus 1.

Through the operation described above, the first patch pattern shown in FIG. 6 is formed on the photosensitive drum 11.

In the next step, the image forming apparatus 1 transfers the first patch pattern to the transfer belt 46, and the density sensor 40 measures a density of the pattern thus transferred, i.e., the first patch pattern on the transfer belt 46. Then, the measurement number count unit 58*b* of the calculation unit 58 checks a number of the density measurements to determine whether the density measurement number is equal to or exceeds three times.

When it is determined that the density measurement number is equal to or exceeds three times, the comparison unit 58*c* compares the density with the standard density. When it is determined that the density measurement number does not exceed three times, that is, less than three times, the density of the patch pattern V3 of the first patch pattern is compared with a threshold value to determine whether the density of the patch pattern V3 is equal to or less than the threshold value.

When the density of the patch pattern V3 is more than the threshold value, that is, exceeds the threshold value, the pattern forming unit 53 forms the second patch pattern, and the density of the patch pattern V3 is measured one more time. As shown in FIG. 5, the second patch pattern has the width same as the effective developing width or the effective image width. Further, the second patch pattern has the length in the longitudinal direction thereof greater than the outer circumferential length of either of the developing roller 14 or the toner supply roller 15, which is longer than the other.

When the density of the patch pattern V3 is equal to or less than the threshold value, the comparison unit 58*c* compares the density with the standard density. More specifically, the comparison unit 58*c* compares the density of the patch pattern V3 with the standard density table 62 stored in advance.

When the density of the patch pattern V3 is greater than the standard density, the comparison unit 58*c* compares the density with the values stored in advance, and the voltage determination unit 58*a* determines the bias value. More specifically, an optimal bias value is determined with reference to the bias correction table 61. After the developing bias is decreased, the printing operation is performed.

When the density of the patch pattern V3 is smaller than the standard density, the comparison unit 58*c* compares the density with the values stored in advance, and the voltage determination unit 58*a* determines the bias value. More specifically, an optimal bias value is determined with reference to the bias correction table 61. After the developing bias is increased, the printing operation is performed.

Further, when the density of the patch pattern V3 is equal to the standard density, the voltage determination unit 58*a* adopts the developing bias value at power on, and the printing operation is performed.

The flow chart shown in FIG. 13 will be explained next. In step S21, power is turned on. In step S22, the voltage (a CH voltage) is applied to the charge roller 12. In step S23, the exposure area is changed, and the static latent image of the patch patterns V1 to V5 is formed. In step S24, the static latent image is developed.

In step S25, the first patch pattern is transferred to the transfer belt 46. In step S26, the density sensor 40 measures the density of the first patch pattern thus transferred. In step S27, it is determined whether the density measurement number is equal to or greater than three times. When it is determined that the density measurement number is equal to or greater than three times, the process proceeds to step S30. When the density measurement number is equal to or less than two times, the process proceeds to step S28.

In step S28, it is determined whether the density of the patch pattern V3 is equal to or less than the threshold value. When it is determined that the patch pattern V3 is equal to or less than the threshold value, the process proceeds to step S30. When it is determined that the patch pattern V3 is not equal to or less than the threshold value, the process proceeds to step S29.

In step S29, the second patch pattern is formed. In step S30, the density is compared with the standard density. When the density is smaller than the standard density, the process proceeds to step S31. When the density is greater than the standard density, the process proceeds to step S33. When the density is equal to the standard density, the process proceeds to step S35.

In step S31, the density is compared with the value stored in advance to determine the bias value. In step S32, the bias value is increased. In step S33, the density is compared with the value stored in advance to determine the bias value. In step S34, the bias value is decreased. In step S35, the bias value before power on is adopted. In step S36, the printing operation is performed, thereby completing the process.

The threshold value to be compared with the density of the patch pattern V3 will be explained next.

Figure 14:
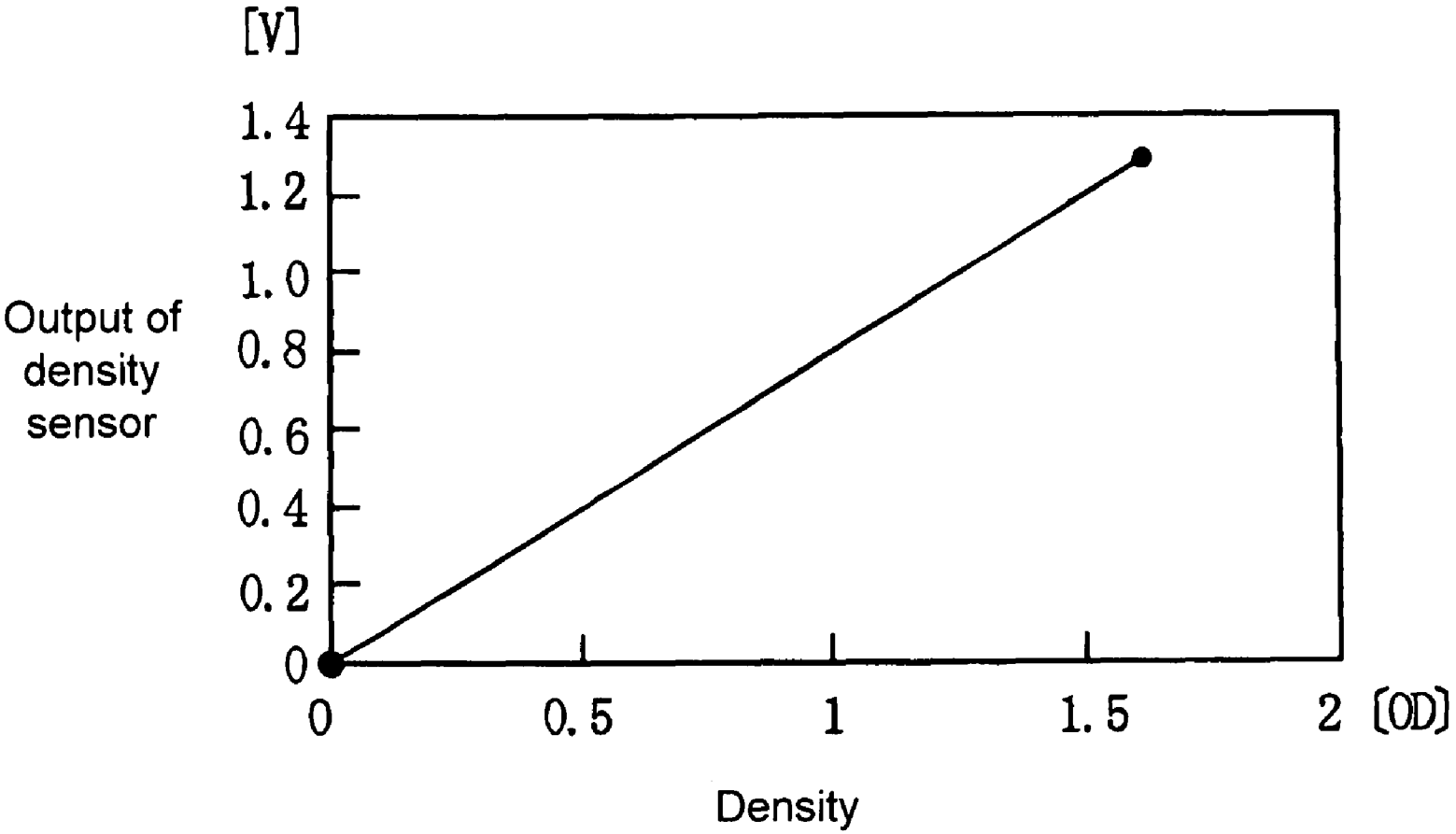
FIG. 14 is a graph showing a relationship between a density of yellow, magenta, and cyan and an output of a density sensor according to the second embodiment of the present invention.
Figure 15:
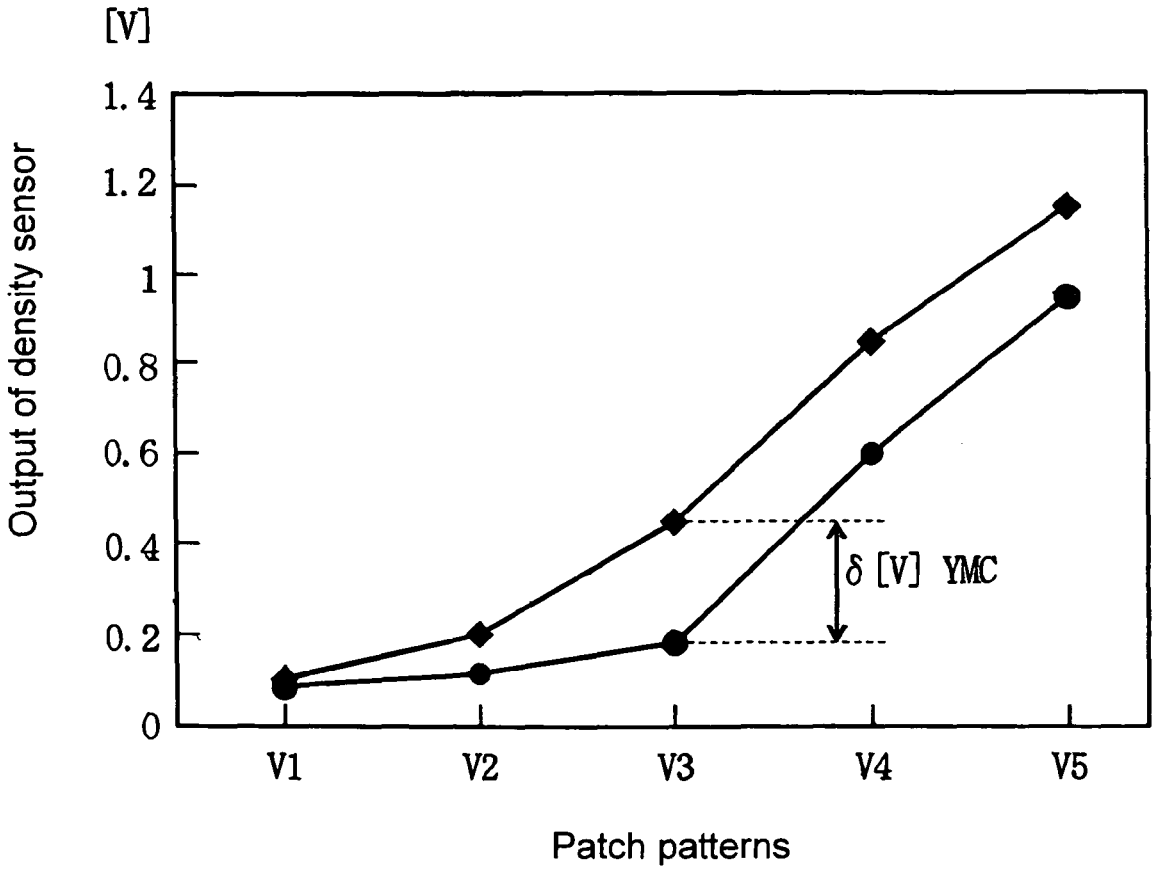
FIG. 15 is a table and a graph showing a relationship between patch patterns V1 to V5 of yellow, magenta, and cyan and the output of the density sensor according to the second embodiment of the present invention.
Figure 16:
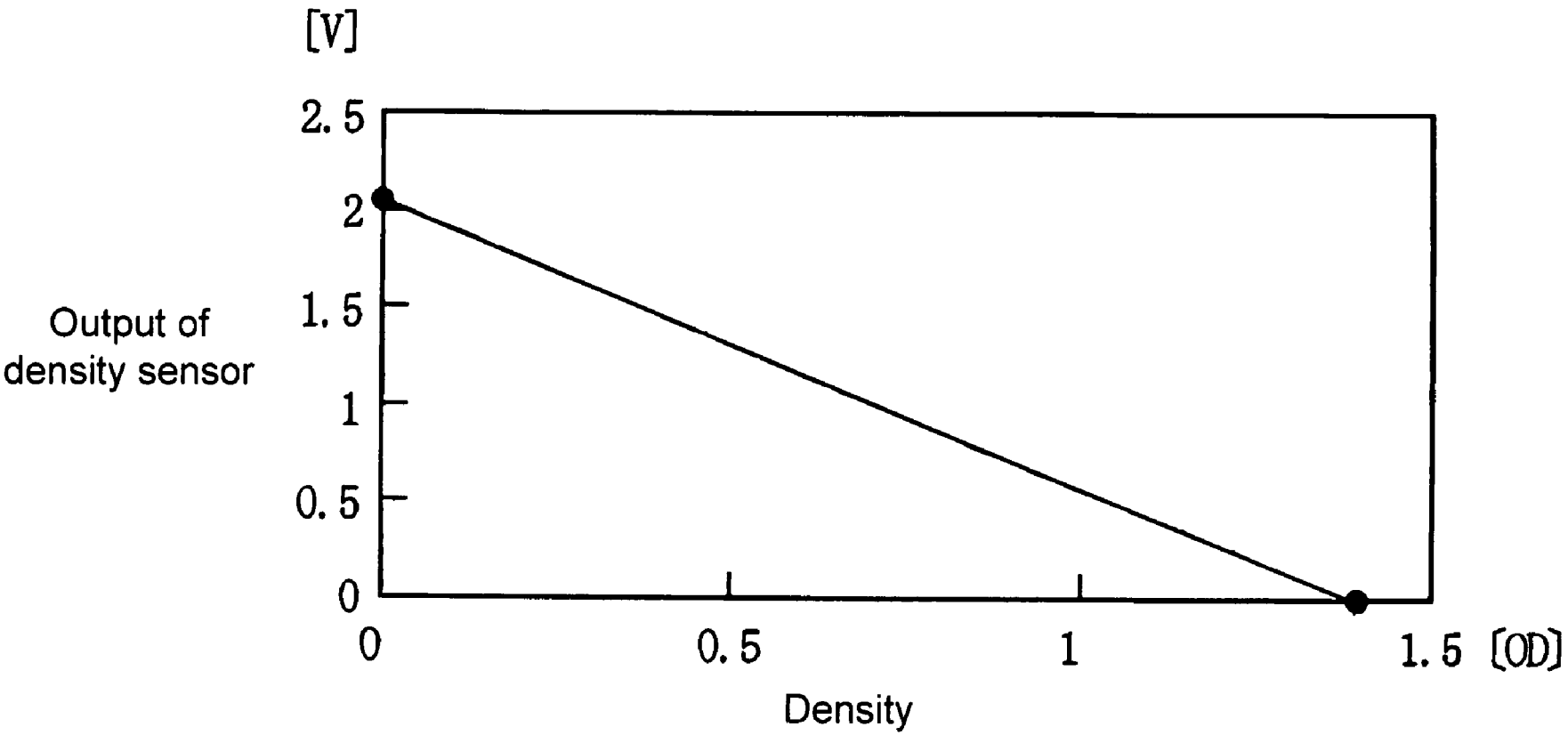
FIG. 16 is a graph showing a relationship between a density of black and the output of the density sensor according to the second embodiment of the present invention.
Figure 17:
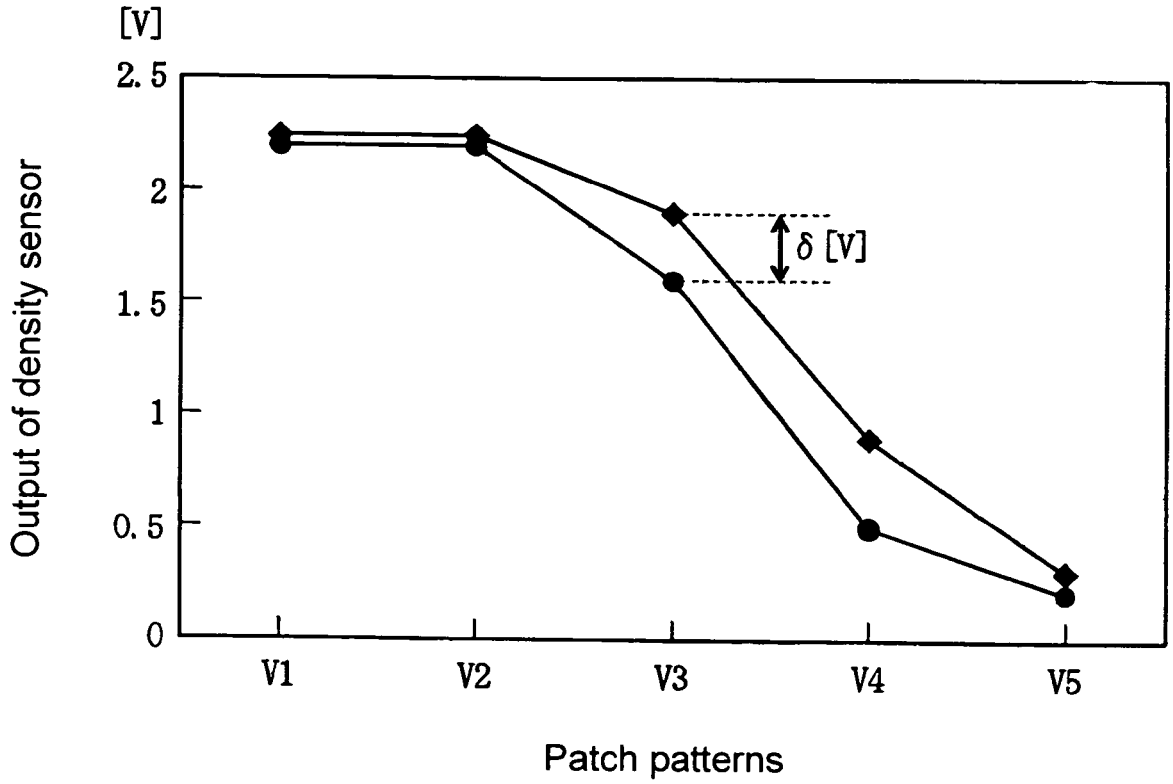
FIG. 17 is a table and a graph showing a relationship between the patch patterns V1 to V5 of black and the output of the density sensor according to the second embodiment of the present invention.
Figure 18:
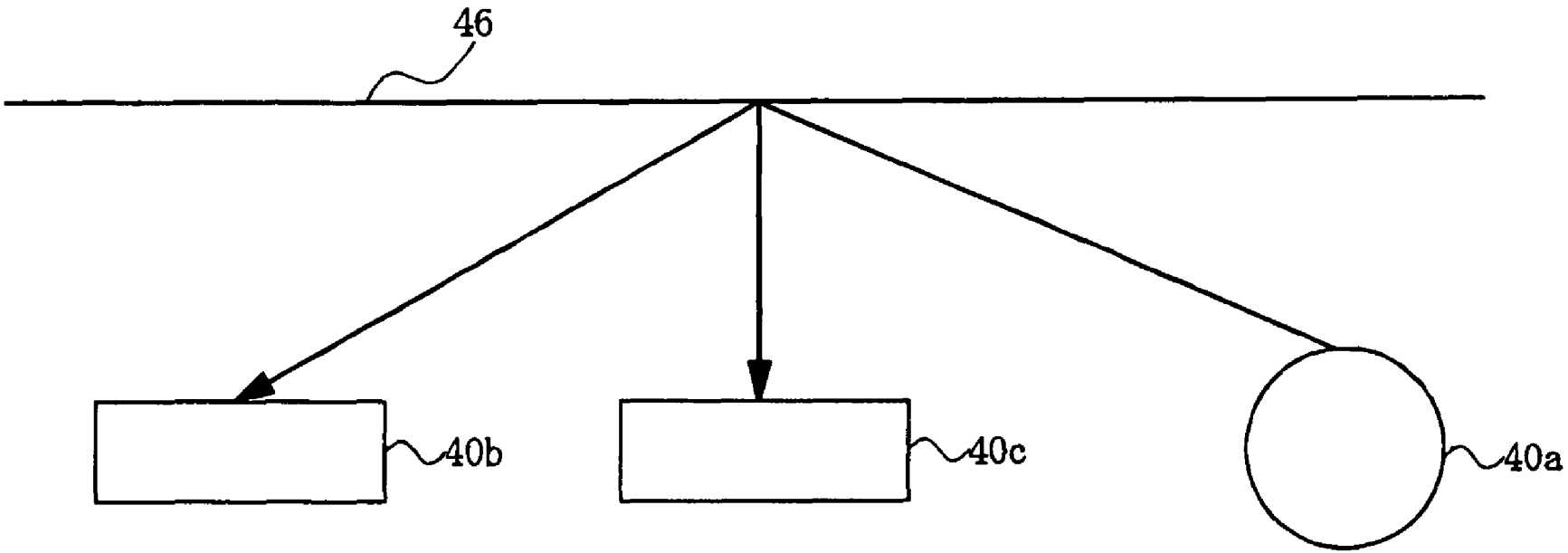
FIG. 18 is a schematic view showing a positional relationship between a transfer belt and the density sensor according to the second embodiment of the present invention.

FIG. 14 is a graph showing a relationship between a density of yellow, magenta, and cyan and an output of the density sensor 40 according to the second embodiment of the present invention. FIG. 15 is a table and a graph showing a relationship between the patch patterns V1 to V5 of yellow, magenta, and cyan and the output of the density sensor 40 according to the second embodiment of the present invention. FIG. 16 is a graph showing a relationship between a density of black and the output of the density sensor 40 according to the second embodiment of the present invention. FIG. 17 is a table and a graph showing a relationship between the patch patterns V1 to V5 of black and the output of the density sensor 40 according to the second embodiment of the present invention. FIG. 18 is a schematic view showing a positional relationship between the transfer belt 46 and the density sensor 40 according to the second embodiment of the present invention.

In FIG. 14, the horizontal axis represents the density, and the vertical axis represents the output of the density sensor 40. In the graph shown in FIG. 15, the horizontal axis represents the patch patterns V1 to V5, and the vertical axis represents the output of the density sensor 40. In FIG. 16, the horizontal axis represents the density, and the vertical axis represents the output of the density sensor 40. In the graph shown in FIG. 18, the horizontal axis represents the patch patterns V1 to V5, and the vertical axis represents the output of the density sensor 40.

As shown in FIG. 14, the density of yellow, magenta, and cyan is proportional to the output of the density sensor 40. As shown in FIG. 16, the density of black is inversely proportional to the output of the density sensor 40.

In the table shown in FIG. 15, the output F of the density sensor 40 is greater than the standard D. The threshold value δ is defined as a difference between the output of the density sensor 40 and the standard value at the patch pattern V3. When the difference is greater than 0.3 V, it is determined that a stain occurs and the second patch pattern is formed.

When FIGS. 14 and 15 are compared with FIGS. 16 and 17, it is noted that the relationship between the density and the output of the density sensor 40 and the relationship between the patch pattern and the output of the density sensor 40 are reversed between the case of black and the case of yellow, magenta, and cyan. This is because the density sensor 40 measures the density of the toner 17 transferred to the transfer belt 46.

In general, the transfer belt 46 has conductivity adjusted through a carbon content, so that the transfer belt 46 has a black color. Accordingly, an image in black does not cause irregular reflection on the transfer belt 46. For this reason, as shown in FIG. 18, a light receiving element of the density sensor 40 for black is disposed at a position different from that for yellow, magenta, and cyan.

More specifically, as shown in FIG. 18, the density sensor 40 includes a light receiving element 40*a*; a light receiving element 40*b* for black; and a light receiving element 40*c* for yellow, magenta, and cyan (YMC). Note that when the position of the light receiving element 40*b* for black is exchanged with the position of the light receiving element 40*c* for YMC, the relationship between the density and the output of the density sensor 40 and the relationship between the patch pattern and the output of the density sensor 40 are not changed in the case of black and the case of yellow, magenta, and cyan.

While the light receiving element 40*c* for YMC receives light irregularly reflected, the light receiving element 40*b* for black receives light regularly reflected. Accordingly, in the case of black, when the density increases, the light receiving element 40*b* for black receives light with a lower intensity. When the density decreases, the light receiving element 40*b* for black receives light with a higher intensity. On the other hand, in the case of yellow, magenta, and cyan, when the density increases, the light receiving element 40*c* for YMC receives light with a higher intensity. When the density decreases, the light receiving element 40*c* for YMC receives light with a lower intensity.

Note that, in the first embodiment shown in FIGS. 7 and 8, the photosensitive drum 11 has a color of green. Both of the light receiving element 40*b* for black and the light receiving element 40*c* for YMC are capable of receiving light irregularly reflected. Accordingly, when the density of the toner 17 on the photosensitive drum 11 is measured, the density sensor 40 tends to generate an output at a same level in the case of black and the case of yellow, magenta, and cyan.

As described above, in the second embodiment, the density of the patch pattern V3 transferred to the transfer belt 46 is measured. Accordingly, even when the image forming apparatus 1 is the tandem type printer, it is necessary to provide just one density sensor 40. Accordingly, it is not necessary to consider a variance in sensitivity of the density sensor 40, thereby making it possible to accurately perform the density correction.

Third Embodiment

A third embodiment of the present invention will be described below. In the description below, elements in the third embodiment similar to those in the first and second embodiments are designated by same reference numerals, and explanations thereof are omitted. Explanations of operations and effects in the third embodiment similar to those in the first and second embodiments are omitted.

Figure 19:
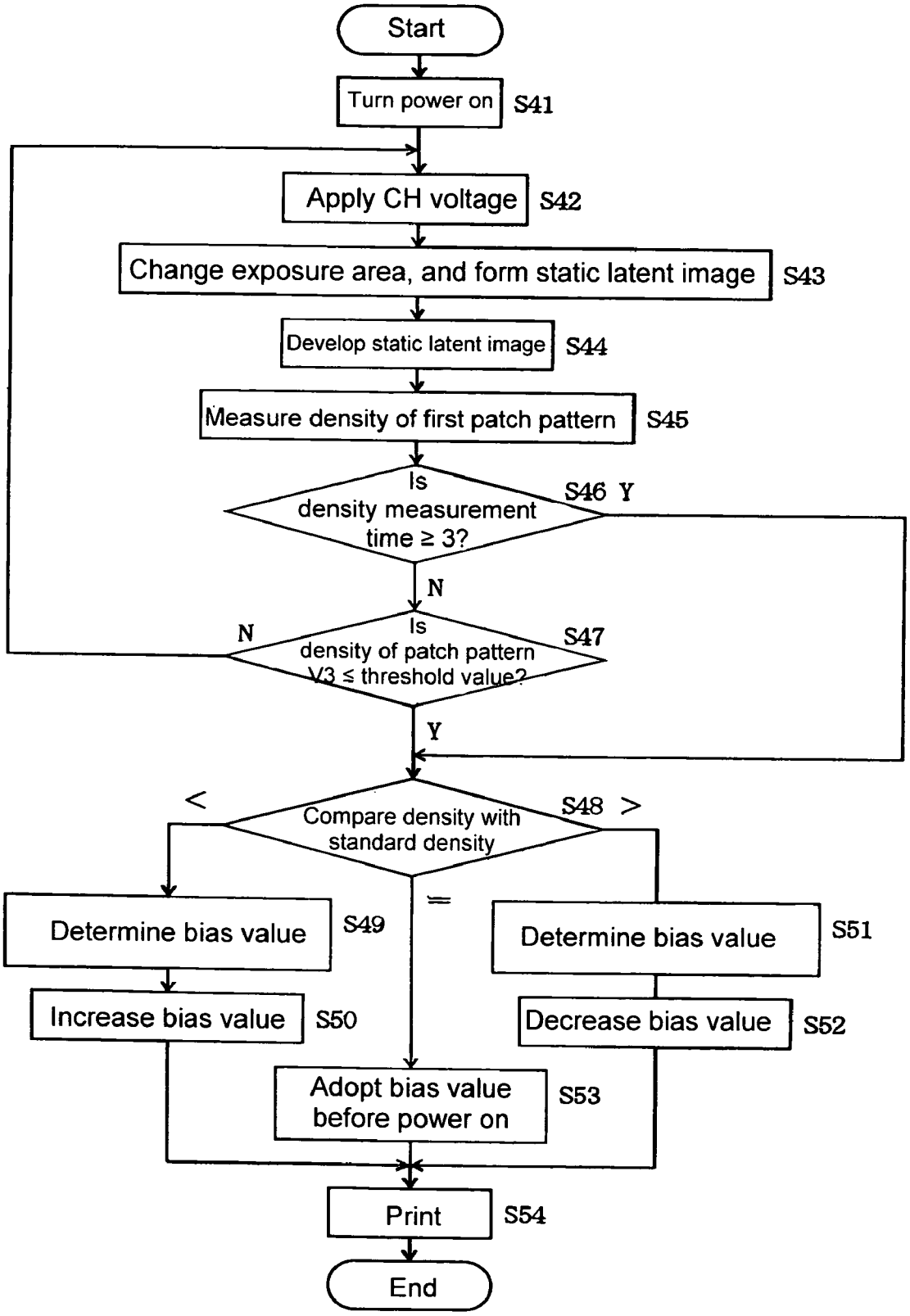
FIG. 19 is a flow chart showing an operation of an image forming apparatus according to a third embodiment of the present invention.
Figure 20:
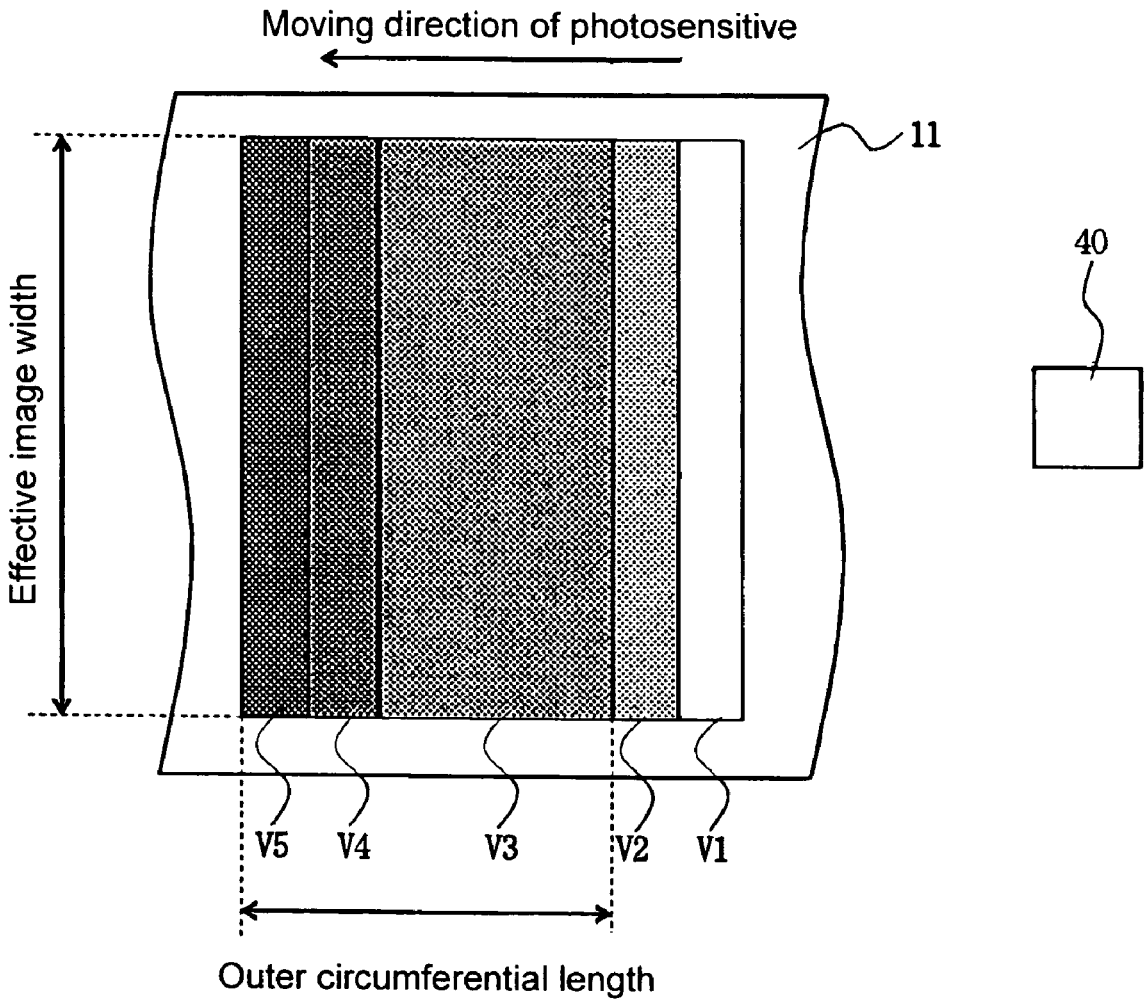
FIG. 20 is a schematic view showing a patch pattern according to the third embodiment of the present invention.

FIG. 19 is a flow chart showing an operation of the image forming apparatus 1 according to a third embodiment of the present invention. FIG. 20 is a schematic view showing a patch pattern according to the third embodiment of the present invention.

In the third embodiment, the image forming apparatus 1 has a configuration similar to that in the second embodiment, and an explanation thereof is omitted. An operation of the density correction will be explained.

When the image forming apparatus 1 is turned on, a voltage supply unit (not shown) applies a voltage to the charge roller 12 to charge the photosensitive drum 11 as the first, second, and third patch patterns shown in FIG. 20. At this moment, the voltage determination unit 58*a* determines a charge potential according to a potential environment correction data table. Then, the light source 13 changes the exposure area in the patch patterns V1 to V5.

In the embodiment, it is configured such that the patch pattern V5 has a density of 100%; the patch pattern V4 has a density of 70%; the patch pattern V3 has a density of 50%; the patch pattern V2 has a density of 30%; and the patch pattern V1 has a density of 10%. For example, when the patch pattern V5 has a density of 100%, the light source 13 turns on all the time. When the patch pattern V3 has a density of 50%, the light source 13 repeats on and off alternately. Note that an exposure amount of the light source 13 is automatically determined according to an environment when the image forming apparatus 1 is turned on.

In the next step, the static latent image on the photosensitive drum 11 is developed. At this time, the voltage determination unit 58*a* determines the developing bias applied to the developing roller 14 and the sponge bias applied to the toner supply roller 15 according to an environment upon turning on the image forming apparatus 1.

Through the operation described above, the patch pattern shown in FIG. 20 is formed on the photosensitive drum 11. The patch pattern has the width same as the effective developing width or the effective image width. Further, the patch pattern has the length in the longitudinal direction thereof greater than the outer circumferential length of either of the developing roller 14 or the toner supply roller 15, which is longer than the other.

In the embodiment, the length of the patch pattern or the developer discarding pattern is determined with a method similar to that of determining the length of the second patch pattern in the first embodiment.

In the embodiment, the length of the patch pattern is set to be a distance from a front edge of the patch pattern in a direction that the photosensitive drum 11 moves to a boundary between the patch pattern V3 and the patch pattern V2, that is, a distance between a front edge of the patch pattern V5 and a rear edge of the patch pattern V3. Accordingly, it is possible to use the pattern having a density greater than 50% as the developer discarding pattern.

In the embodiment, the developer discarding pattern has the density of greater than 50%; the width equal to the effective image width; and the length determined with the method similar to that in the first embodiment. Accordingly, it is possible to discard a sufficient amount of the toner 17.

In the embodiment, the density sensor 40 measures the density of the patch pattern thus developed. Then, the measurement number count unit 58*b* checks a number of the density measurements to determine whether the density measurement number is equal to or exceeds three times.

When it is determined that the density measurement number is equal to or exceeds three times, the comparison unit 58*c* compares the density with the standard density. When it is determined that the density measurement number does not exceed three times, that is, less than three times, the density of the patch pattern V3 of the first patch pattern is compared with the threshold value to determine whether the density of the patch pattern V3 is equal to or less than the threshold value.

When the density of the patch pattern V3 is more than the threshold value, that is, exceeds the threshold value, the density sensor 40 measures the density one more time. When the density of the patch pattern V3 is equal to or less than the threshold value, the comparison unit 58*c* compares the density with the standard density. More specifically, the comparison unit 58*c* compares the density of the patch pattern V3 with the standard density table 62 stored in advance.

When the density of the patch pattern V3 is greater than the standard density, the comparison unit 58*c* compares the density with the values stored in advance, and the voltage determination unit 58*a* determines the bias value. More specifically, an optimal bias value is determined with reference to the bias correction table 61. After the developing bias is decreased, the printing operation is performed.

When the density of the patch pattern V3 is smaller than the standard density, the comparison unit 58*c* compares the density with the values stored in advance, and the voltage determination unit 58*a* determines the bias value. More specifically, an optimal bias value is determined with reference to the bias correction table 61. After the developing bias is increased, the printing operation is performed.

Further, when the density of the patch pattern V3 is equal to the standard density, the voltage determination unit 58*a* adopts the developing bias value at power on, and the printing operation is performed.

The flow chart shown in FIG. 19 will be explained next. In step S41, power is turned on. In step S42, the voltage (a CH voltage) is applied to the charge roller 12. In step S43, the exposure area is changed, and the static latent image of the patch patterns V1 to V5 is formed. In step S44, the static latent image is developed.

In step S45, the density sensor 40 measures the density of the patch pattern thus developed. In step S46, it is determined whether the density measurement number is equal to or greater than three times. When it is determined that the density measurement number is equal to or greater than three times, the process proceeds to step S48. When the density measurement number is equal to or less than two times, the process proceeds to step S47.

In step S47, it is determined whether the density of the patch pattern V3 is equal to or less than the threshold value. When it is determined that the patch pattern V3 is equal to or less than the threshold value, the process proceeds to step S48. When it is determined that the patch pattern V3 is not equal to or less than the threshold value, the process returns to step S42.

In step S48, the density is compared with the standard density. When the density is smaller than the standard density, the process proceeds to step S49. When the density is greater than the standard density, the process proceeds to step S51. When the density is equal to the standard density, the process proceeds to step S53.

In step S49, the density is compared with the value stored in advance to determine the bias value. In step S50, the bias value is increased. In step S51, the density is compared with the value stored in advance to determine the bias value. In step S52, the bias value is decreased. In step S53, the bias value before power on is adopted. In step S54, the printing operation is performed, thereby completing the process.

As described above, in the embodiment, the patch pattern has the width equal to the effective developing width. Accordingly, the patch pattern is formed to consume a large amount of the toner 17 and discard the toner 17 thus deteriorated. More specifically, the patch pattern same as the first patch pattern is formed as the second pattern for discarding toner. Accordingly, it is not necessary to form the second pattern, thereby reducing a time until the printing operation starts.

In the first to third embodiments, when the density of the pattern is greater than the threshold value, the toner is discarded. Then, the density is measured one more time, and the density correction is performed according to the density thus measured. In other words, according to the threshold value, the toner is discarded as a density optimization process for adjusting the density of the pattern to an optimal density.

Note that the density optimization process is not limited to the first to third embodiments described above. For example, when the density of the pattern is smaller than the threshold value, the developing roller and the toner supply roller rotate idle without forming the toner image on the photosensitive drum as the density optimization process.

In the first to third embodiments, the developing device of the one-component developing method is explained. The present invention is applicable to a developing device of a two-component developing method using toner and a carrier.

Further, in the embodiments, the printer is explained as the image forming apparatus, and the present invention is applicable to a copier, a facsimile, a multifunction product, and the likes.

The disclosure of Japanese Patent Application No. 2007-207938, filed on Aug. 9, 2007, is incorporated in the application.

While the invention has been explained with reference to the specific embodiments of the invention, the explanation is illustrative and the invention is limited only by the appended claims.

What is claimed is:

1. An image forming apparatus, comprising:

an image supporting member;

an exposure device for forming a static latent image on the image supporting member;

a developing device for developing the static latent image formed on the image supporting member;

an image control unit for controlling a condition for forming an image; and a density sensor for detecting a developer density, wherein said image control unit forms a first pattern for determining whether the developer density is proper, a second pattern for discarding developer when the developer density is greater than a threshold value, and a third pattern for performing density correction.

2. The image forming apparatus according to claim 1, wherein said image control unit is adopted to use the first pattern for the density correction without forming the second pattern when the developer density is equal to or smaller than the threshold value.

3. The image forming apparatus according to claim 1, wherein said image control unit is adopted to form the first pattern same as the third pattern.

4. The image forming apparatus according to claim 1, wherein said image control unit is adopted to form the first pattern same as the second pattern.

5. The image forming apparatus according to claim 1, wherein said image control unit is adopted to form the second pattern having an effective image width.

6. The image forming apparatus according to claim 1, wherein said density sensor is adopted to detect the developer density of the first pattern formed on the image supporting member.

7. The image forming apparatus according to claim 1, further comprising an intermediate transfer member so that the density sensor detects the developer density of the first pattern transferred from the image supporting member to the intermediate transfer member.

8. An image forming apparatus, comprising:

an image supporting member;

an exposure device for forming a static latent image on the image supporting member;

a developing device for developing the static latent image formed on the image supporting member;

an image control unit for controlling a condition for forming an image; and a density sensor for detecting a developer density, wherein said image control unit forms a first density detection pattern so that the density sensor detects the developer density of the first density detection pattern, performs a density optimization process according to the developer density of the first density detection pattern, and forms a second density detection pattern so that the density sensor detects the developer density of the second density detection pattern.

9. The image forming apparatus according to claim 8, wherein said image control unit is arranged to discard developer as the density optimization process when the developer density of the first density detection pattern is greater than a specific level.

10. The image forming apparatus according to claim 8, wherein said image control unit is arranged to rotate a developing roller and a developer supply roller as the density optimization process when the developer density of the first density detection pattern is smaller than a specific level.

11. A method of performing density correction for an image forming apparatus, comprising the steps of:

forming a first pattern;

measuring a first density of the first pattern;

comparing the first density with a threshold, value;

forming a second pattern to discard developer when the first density exceeds the threshold value;

forming a third pattern;

measuring a second density of the third. pattern, and performing the density correction using the second density.

12. The method of performing density correction according to claim 11, further comprising the step of comparing the first density with a standard value when the first density does not exceed the threshold value.

13. The method of performing density correction according to claim 11, further comprising the step of performing a density optimization process when the first density does not exceed the threshold value.

* * * * *